US007261991B2

(12) United States Patent
Yoshizawa et al.

(10) Patent No.: US 7,261,991 B2
(45) Date of Patent: Aug. 28, 2007

(54) IMAGE FORMING METHOD AND IMAGE FORMING APPARATUS

(75) Inventors: Hideo Yoshizawa, Fuchu (JP); Hiroshi Yamazaki, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 422 days.

(21) Appl. No.: 10/925,064

(22) Filed: Aug. 23, 2004

(65) Prior Publication Data

US 2006/0040199 A1 Feb. 23, 2006

(51) Int. Cl.
*G03G 21/00* (2006.01)
*G03G 13/14* (2006.01)
*G03G 9/00* (2006.01)

(52) U.S. Cl. ..... 430/125; 430/126; 430/111.41

(58) Field of Classification Search ..... 430/125, 430/126, 111.41; 399/159
See application file for complete search history.

(56) References Cited

U.S. PATENT DOCUMENTS 6,372,400 B1 * 4/2002 Yoshizaki et al. ..... 430/111.32
2001/0031412 A1 * 10/2001 Itami et al. ..... 430/58.15

* cited by examiner

*Primary Examiner*—Mark A. Chapman
(74) *Attorney, Agent, or Firm*—Lucas & Mercanti, LLP

(57) ABSTRACT

An image forming method, comprising the steps of: charging a organic photoreceptor having a specific layer including at least a photosensitive layer; forming an electrostatic latent image on the organic photoreceptor; developing the electrostatic latent image to form a visible toner image by using a developing agent; transferring the toner images to be superimposed on a toner image receiving member; and removing the toner remaining on the organic photoreceptor, wherein the total thickness of the specific layer in the organic photoreceptor, is 5-15 μm, and wherein the developing agent comprises a toner and a carrier having the volume resistivity of $10^8$-$10^{12}$ Ω cm.

16 Claims, 7 Drawing Sheets

FIG. 2 ( a )
NON-ANGULAR TONER PARTICLES
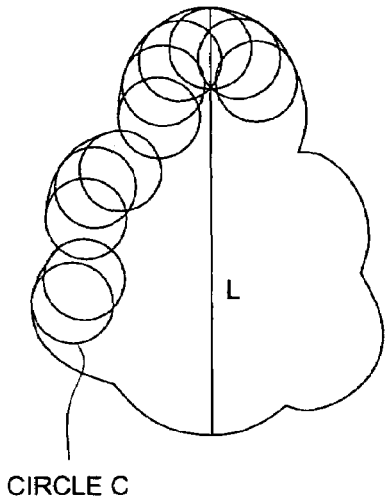
FIG. 2 ( b )
ANGULAR TONER PARTICLES
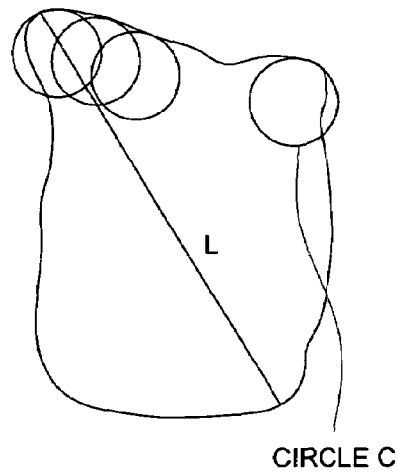
FIG. 2 ( c )
ANGULAR TONER PARTICLES
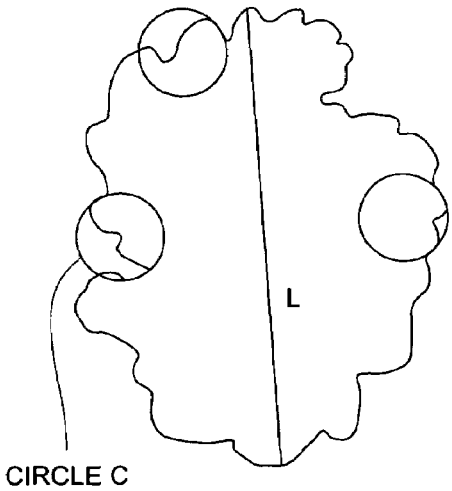

IMAGE FORMING METHOD AND IMAGE FORMING APPARATUS

FIELD OF THE INVENTION

The present invention relates to an image forming method and an image forming apparatus for use in the fields of electrophotographic copy machines and printers.

BACKGROUND OF THE INVENTION

In recent years, organic photoreceptors have been widely used in electrophotoreceptors. The organic photoreceptor is advantageous when compared to other photoreceptors because: the material for all types of exposure light sources, from visible light to infrared light, can be easily developed; materials which do not cause environmental pollution can be selected; and manufacturing cost is low. However, drawbacks of the organic photoreceptor are that mechanical strength and chemical durability are low, and when multiple sheet printing is done, there is deterioration of the electrostatic characteristics of the photoreceptor, or generation of defects on the photoreceptor surface and the like.

In other words, because electrical and mechanical external forces may be directly applied to the organic photoreceptor (hereinafter sometimes simply referred to as photoreceptor) by the charging means, developing means, transfer means and cleaning means, the organic photoreceptor must be resistant to these external forces.

More specifically, the photoreceptor must be resistant to wear or cracks generated on the photoreceptor surface due to friction; active oxygen such as ozone and the like that is generated when corona charging is done; and surface deterioration due to nitrogen oxides and the like.

In order to solve the above-described problems relating to mechanical and chemical durability, a structure is often employed in which the organic photoreceptor has a layer structure such that a charge generation layer and a charge transfer layer are superposed, and the charge transfer layer which is the protective layer is a uniform layer which is high in strength and through which an active gas cannot easily pass, and the thickness of the charge transfer layer is greater than 20 μm.

Also, there has been another approach of studying the technology of disposing a high-strength protective layer on the surface of the photoreceptor. For example, the use of a hard silicone resin as the protective layer of the photoreceptor has been reported (Patent Document 1). However, in the aforementioned methods in which the charge transfer layer is made thick or a high-strength protective layer is provided, there is the problem that the carrier generated at the charge transfer layer diffuses in the horizontal direction and reaches as far as the surface, and this causes problems with sharpness and the like. In the digital photocopier field, the demand for higher quality images has been increasing, and high resolution image formation is being researched, but in this type of layer structure or in the protective layer in which carrier diffusion occurs easily, a favorable electrostatic latent image cannot be obtained.

In order to obtain a high quality electrophotographic image, the image information must be reproduced as a latent electrostatic image so as to be faithful to the original, and the electric potential contrast of the exposed/unexposed parts on the organic photoreceptor must be formed so as to be sharp. However, in order to do this, it is necessary to limit the diffusion of the carrier generated so that it does not reach the surface charge. It has been reported that in latent image deterioration of a high density image, when the ratio D/μ of the diffusion constant of the charge transfer layer (D) and the drift mobility (μ) is large, the effect of diffusion to the electrostatic latent image cannot be disregarded, and when the charge transfer layer is thick, latent image deterioration increases (Non-patent Document 1).

In addition, it has been reported that a photoreceptor whose film is made thin has the effect of preventing diffusion of the toner image (Patent Document 2), and that high quality electrophotographic images are formed with a thin photoreceptor whose electrostatic capacity is large (Patent Document 3). Similarly, an organic photoreceptor has been proposed in which the charge transfer layer is made thin and diffusion of the electrostatic latent image is prevented (Patent Document 4).

However, when these thin organic photoreceptors which have been proposed are actually used in electrophotographic image forming apparatuses, when the image is formed, image unevenness due to uneven mechanical abrasion is more likely to be outstanding. Furthermore, it is more difficult to maintain image quality over a long period of time when compared with the organic photoreceptor of the prior art that has a thickness of 20 μm or more. It is thought that the reason for this is that as shown in FIG. 1, (which shows dependency of reduction in electric potential carrying capacity on layer thickness) in the case where the amounts of abrasion are the same, the reduction in electric potential carrying capacity ($\Delta V_1 > \Delta V_2$) is larger as the thickness of the photosensitive layer gets smaller. Consequently, when a thin organic photoreceptor is used, image unevenness is likely to occur due to unevenness in abrasion of the organic photoreceptor.

In addition, when a thin organic photoreceptor is used and a developing agent having small particle diameter toner is employed in order to obtain high image quality, at those portions of the organic photoreceptor where abrasion unevenness occurs, mackle is likely to occur. This is thought to occur because of the presence on the organic photoreceptor, of toner components which tend to splash onto the rough regions which result from the unevenness of surface abrasion

[Patent Document 1]

Japanese Application Patent Laid-Open Publication No. Hei 06-118681 gazette

[Patent Document 2]

Japanese Application Patent Laid-Open Publication No. 2001-209206 gazette

[Patent Document 3]

Japanese Application Patent Laid-Open Publication No. 2001-312082 gazette

[Patent Document 4]

Japanese Application Patent Laid-Open Publication No. Hei 05-119503 gazette

[Non-Patent Document 1]

Japan Images Society Magazine, Volume 38 Issue 4, Page 296

The object of the present invention is to solve the aforementioned problems and thereby provide an electrophotographic image which uses a thin organic photoreceptor, and has high image quality over a long period, and to further provide an image forming method and image forming apparatus which use an organic photoreceptor in which there is little image unevenness or mackle.

SUMMARY OF THE INVENTION

As a result of continuous study of the aforementioned problem, we have used an organic photoreceptor that has been made thin to improve sharpness, and we have found that in order to prevent the occurrence of image unevenness and mackle caused by abrasion unevenness of the organic photoreceptor, it is effective to use a development method in which, concentrated image unevenness in image density is not allowed to occur even if there is abrasion unevenness on the surface of the organic photoreceptor. The present invention was thereby brought to completion. That is to say, a two-component developing agent with favorable developing properties whose carrier resistivity is within a specified range was used to visualize the electrostatic latent image formed on an organic photoreceptor that has been made thin, and thus image unevenness and mackle was prevented and the present invention was thereby achieved.

It was also discovered that by using a toner in which the proportion of the fine toner is reduced in the two-component developing agent aforementioned, the objects of the present invention were more notably achieved, and the present invention was thereby brought to completion. That is to say, the objects of the present invention are achieved by the configuration described below.

1. An image forming method in which an organic photoreceptor is charged with electricity then an electrostatic latent image is formed, and in the development process for said electrostatic latent image the toner image is made visible, and after said toner image is transferred to a recording paper, the toner remaining on the organic photoreceptor is removed; wherein the total thickness of the photosensitive layer and the protective layer which is provided in accordance with necessity in said organic photoreceptor, is 5-15 μm, and the developing agent which is used in the development process comprises a toner and a carrier and the volume resistivity of the carrier is $10^8$-$10^{12}$ Ω cm.

2. An image forming method in which an organic photoreceptor is charged with electricity then an electrostatic latent image is formed, and in the development process for said electrostatic latent image the toner image is made visible, and after said toner image is transferred to a recording paper, the toner remaining on the organic photoreceptor is removed; wherein the total thickness of the photosensitive layer and the protective layer which is provided in accordance with necessity in said organic photoreceptor, is 5-15 μm, and the developing agent which is used in the development process comprises a toner and a carrier and the volume resistivity of the carrier is $10^8$-$10^{12}$ Ω cm, and the toner comprises 65% or more in terms of number of toner particles that have a shape coefficient in the range from 1.2-1.6.

3. An image forming method in which an organic photoreceptor is charged with electricity then an electrostatic latent image is formed, and in the development process for said electrostatic latent image the toner image is made visible, and after said toner image is transferred to a recording paper, the toner remaining on the organic photoreceptor is removed; wherein the thickness of the photosensitive layer of the organic photoreceptor is 5-15 μm; and the developing agent which is used in the development process comprises a toner and a carrier, and the volume resistivity of the carrier is $10^8$-$10^{12}$ Ω cm; and if particle diameter of the toner particle is D (μm), in the histogram which shows the particle distribution based on numbers, in which the natural logarithm 1 nD is taken as the horizontal axis and said horizontal axis is divided into a plurality of classes at an interval of 0.23, the total (M) of the relative frequency ($m_1$) of toner particles included in the highest frequency class and relative frequency ($m_2$) of the toner particles included the second highest frequency class is at least 70%.

4. The image forming method aforementioned in any one of Structures 1-3, wherein the toner comprises an organic external agent with a particle diameter of 0.01-1.0 μm.

5. The image forming method aforementioned in any one of Structures 1-4, wherein the surfaces of the magnetic particles of the carrier are coated with a silicone polymer.

6. The image forming apparatus which uses an image forming method aforementioned in any one of Structures 1-5 to form electrophotographic images.

BRIEF DESCRIPTION OF THE DRAWINGS

FIG. 2(*a*) is an explanatory diagram showing a projection image of a non-angular toner particle, and FIGS. 2(*b*) and (*c*) respectively are explanatory diagrams showing the projection image of angular toner particle.

DETAILED DESCRIPTION OF THE PREFERRED EMBODIMENTS

Figure 1:
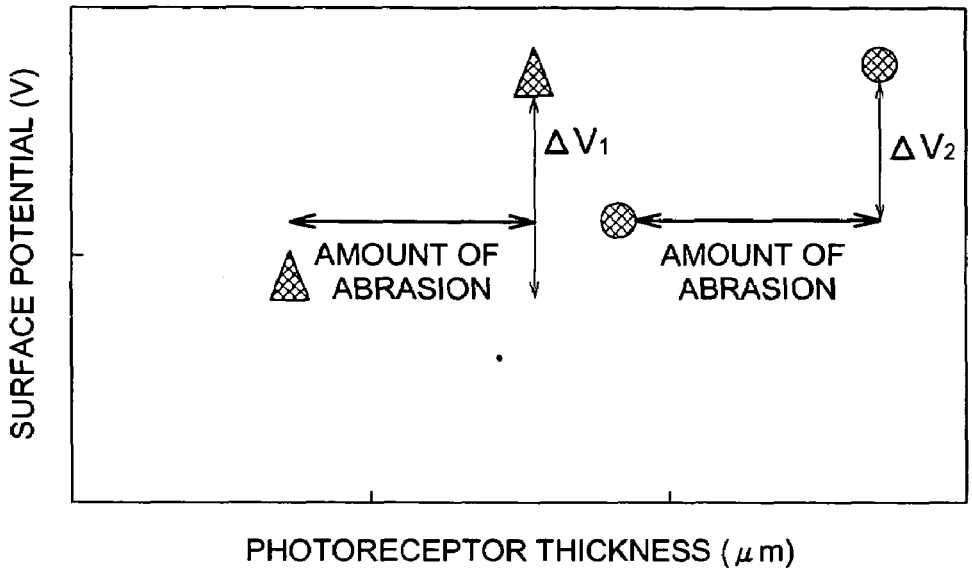
FIG. 1 is a diagram showing dependence of reduction in electric potential carrying capacity on film thickness.

The following is a detailed description of the present invention.

(Total Film Thickness of the Photosensitive Layer and the Protective Layer)

The total film thickness of the photosensitive layer and the protective layer which is provided if necessary is 5-15 μm in the organic photoreceptor used in the image forming method of the present invention.

In the present invention, organic photoreceptor refers to an electrophotoreceptor comprising an organic compound that has at least one of the charge generation function and the charge transfer function which are essential in the structure of an electrophotoreceptor, and examples include known organic photoreceptors such as those comprising known organic charge generation substances or organic charge transfer materials, and photoreceptors having charge generation function and the charge transfer function imparted by a high polymer chain.

The photosensitive layer of the present invention refers to a layer having at least one of the function of generating a charge carrier due to exposure to light and the function of transferring said carrier. These functions may be provided in a single layer structure or in a layer structures having at least 2 layers. It is preferable that the layer configuration of the organic photoreceptor of the present invention is basically such that the photosensitive layer comprises a charge generation layer and a charge transfer layer on a conductive support. The most preferable configuration is one in which the photosensitive layer comprises a charge generation layer and more than one charge transfer layers.

In addition, the protective layer of the organic photoreceptor of the present invention may or may not have charge transfer functions. For example, it may simply be a protective layer or may also function as a charge injection layer. The organic photoreceptor of the present invention may not be provided with a protective layer with functions especially for protection. In that case, the charge transfer layer and the like will be the surface layer.

The total film thickness of the photosensitive layer and the protective layer which is provided if necessary in the present invention, does not include the intermediate layer or the conductive layer provided between the photosensitive layer and the conductive substrate, nor does it include the semiconductor layer. That is to say, the total film thickness of the photosensitive layer and the protective layer is also an important factor affecting the formation of the high quality electrophotographic image (high quality electrostatic latent image). However, the effect of the thickness of the intermediate layer and the conductive layer or the semiconductor layer on image quality at the time of exposure is small compared to that of the total film thickness of the photosensitive layer and the protective layer.

In the layer structure in which the total film width of the photosensitive layer and the protective layer which is provided if necessary in the organic photoreceptor of the present invention is 5-15 μm and which comprises a plurality of charge transfer layers and charge generation layers, it is preferable that the thickness thereof is 5-15 μm. If the total film thickness is less than 5 μm, it is likely that the charge potential will be insufficient, while if it exceeds 15 μm, the sharpness will not be sufficiently improved. In particular, when the total film thickness of a plurality of charge transfer layers is 8-14 μm, the effect of sharpness improvement is more notable.

The following is a description of the composition of organic photoreceptors used in the present invention, other than that aforementioned. The layer composition of the organic photoreceptor of the present invention is basically a photosensitive layer comprising a charge generation layer and a charge transfer layer disposed on a conductive support. The most preferable composition is one in which the photosensitive layer comprises a charge generation layer and a plurality of charge transfer layers.

The specific structure of the photoreceptor used in the present invention will be described in the following.

Conductive Support

The conductive support used in the photoreceptor of the present invention may be a sheet-like or a cylindrical conductive support.

The cylindrical conductive support of the present invention refers to the cylindrical support which is necessary so that images can be formed endlessly by rotation, and a conductive support whose straightness is in the range of 0.1 mm or less and whose deflection is in the range of 0.1 mm or less. If this range for straightness and deflection is exceeded, favorable image formation will be difficult.

Examples of the material for the conductive support include: a metal drum formed of aluminum or nickel, or a plastic drum which is vapor deposited with aluminum, stannic oxide, indium oxide or the like, or a paper or plastic drum onto which a conductive material has been coated. The conductive support preferably has a specific resistivity of $10^3$ Ω cm or less at normal temperatures.

The conductive support used is in the present invention may be one on whose surface an alumite film that has been subjected to sealing is formed. The alumite treatment is normally carried out in, for example, in an acid solution such as chromic acid, sulfuric acid, oxalic acid, phosphoric acid, boric acid, sulfamic acid and the like, but anodizing in sulfuric acid is gives the most favorable effect. In the case where anodizing is done in sulfuric acid, it is preferable that the concentration of sulfuric acid is 100-200 g/l, the aluminum ion concentration is 1-10 g/l, the liquid temperature is about 20° C. and the voltage applied is approximately 20 V, but the anodizing is not to be limited thereby. Also, the average thickness of the anodizing film coat is generally 20 μm or less, and a thickness of 10 μm is particularly preferable.

Intermediate Layer

In the present invention, it is preferable to provide the aforementioned intermediate layer which functions as a barrier, between the support and the photosensitive layer.

It is preferable that the intermediate layer includes titanium oxide in the aforementioned binder resin whose absorption coefficient is small. The average particle diameter of the titanium oxide particles is preferably in the range between 10 nm and 400 nm and more preferably in the range between 15 nm and 200 nm in terms of the number-based average primary particle diameter. If the size is smaller than 10 nm the effect of preventing Moire generation in the intermediate layer is small. On the other hand, if the size exceeds 400 nm, occurrence of precipitation of the titanium oxide particles in the intermediate layer coating solution becomes likely, and as a result, the uniform distribution of the titanium oxide particles in the intermediate layer becomes poor, and also an increase in black spotting is likely to occur. The intermediate layer coating solution using titanium oxide particles for which number-based average primary particle diameter is in the range defined above is favorable, and the intermediate layer that is formed from this type of coating solution functions to prevent the generation of black spotting, and in addition, is favorable in terms of environmental properties and its resistance to cracking.

The titanium oxide particles used in the present invention may have a dendrite, needle shaped, or granular configuration, and the titanium oxide particles having these configurations may for example be a crystalline type such as an anatase type, a rutile type or an amorphous type for the titanium oxide crystal. Any of the crystal types may be used, and 2 or more of the crystal types may be mixed and used. Among these, the rutile type and the granular type are most favorable.

It is preferable that the titanium oxide particles of the present invention undergo surface treatment, and one surface treatment involves carrying out multiple surface treatments, and the last of the multiple surface treatments is one in which a surface treatment using a reactive organic silicon compound is carried out. In addition at least one of the plurality of surface treatments is one in which surface treatment with at least one substance selected from alumina, silica, and zirconia is done, and it is preferable that the surface treatment using the organic silicon compound is carried out last.

It is to be noted that, the alumina treatment, silica treatment, and the zirconia treatment refers to the process of depositing alumina, silica or zirconia on the surface of the titanium oxide particle, and the alumina, silica and zirconia that is deposited on these surfaces also includes hydrated alumina, silica and zirconia. The surface treatment with the reactive organic silicon compound refers to using a reactive organic silicon compound in the treatment solution.

In this manner, by carrying out at least 2 surface processes with titanium oxide particle, the surface of the titanium oxide particles are evenly coated (processed), and by using the titanium oxide that has been subjected to said surface treatment in the intermediate layer, the dispersion of titanium oxide particles such as titanium oxide particles in the intermediate layer is favorable, and a favorable photoreceptor in which there are no image defects such as black spots and the like can be obtained.

An example of the reactive organic silicon compound is the compound represented by the general formula (1), but examples are not limited to the compounds represented below provided that the compound undergoes a condensation reaction with a reactive group such as the hydroxyl group and the like which is at the titanium oxide surface.

General Formula (1)

$$(R)_n—Si—(X)_{4-n}$$

(In the formula, Si is a silicon atom; R represents an organic group in which carbon bonds directly to the silicon atom; X represents a hydrolyzing group; and n represents the integers 0-3.)

In the organic silicon compound represented by general formula (1), examples of the organic group represented by R in which carbon bonds directly to the silicon atom include: alkyl groups such as methyl, ethyl, propyl, butyl, pentyl, hexyl, octyl, dodecyl; aryl groups such as phenyl, tolyl, naphthyl, biphenyl; epoxy containing groups such as γ-glycidoxypropyl, and β-(3,4-epoxycyclohexyl) ethyl; (meta) acryloyl containing groups such as γ-acryloxypropyl, γ-methacryloxypropyl; hydroxyl containing groups such as γ-hydroxypropyl, and 2,3-dihydroxypropyloxypropyl; vinyl containing groups such as vinyl and propenyl; mercapto containing groups such as γ-mercaptopropyl; amino containing group such as γ-aminopropyl, and N-β (aminoethyl)-γ-aminopropyl; halogen containing groups such as γ-chloropropyl, 1,1,1-trifluoropropyl, nonafluorohexyl, and perfluorooctylethyl; as well as nitro and cyano substituted alkyl groups. Examples of the hydrolyzed group X include alkoxy groups such as methoxy and ethoxy, halogen groups and acyloxy groups.

The organic silicon compound represented by general formula (1) may be used singly or in combinations of 2 or more.

In specific examples of the organic silicon compound represented by general formula (1), when n is 2 or more, the plurality of Rs may be the same or different. Similarly when n is 2 or less, the plurality of X may be the same or different. Also, when 2 or more of the organic silicon compound represented by general formula (1) are used, R and X respectively may be the same of different from each other in the compounds.

Examples of the reactive organic silicon compound that is favorably used for the surface treatment include polysiloxane compounds. Polysiloxane compounds with a molecular weight of 1000 to 20000 are generally available, and their effect in preventing the generation of black spotting is favorable. In particular, when methyl hydrogen polysiloxane is used in the last surface treatment, a favorable effect is obtained.

Photosensitive Layer

Charge Generation Layer

The charge generation layer includes a charge generation material (CGM). Other substance may be included in the layer such as a binder resin and other additives as necessary.

Known charge generation materials (CGM) may be used as the charge generation material (CGM). Phythalocyanine pigments, azo pigments, perylene pigments, azulenium pigments and the like may be used. Among these, the CGM that can be used repeatedly with a minimum increase in the residual charge is 3-dimensional and has a stable coagulate structure between the molecules and has an electric potential structure. Specifically, a CGM such as phythalocyanine pigment and perylene pigment which have crystalline structures are examples. For example, titanyl phythalocyanine has a maximum peak at the Bragg angle 2θ with respect to the Cu-Ka line, of 27.2°, and CGMs such as benzimidazole perylene which has a maximum peak at 2θ of 12.4° have little or no deterioration with repeated use, and the residual electric potential increase is small.

In the case where a binder is used as a CGM dispersant in the charge generation layer, known resins may be used as the binder, but the most favorable resins are Formaldehyde dimethyl acetal resin, butyral resin, silicone resin, silicone modified butyral resin, and phenoxy resin. The proportions of the binder resin to the charge generation material is favorably 20-600 parts by weight for 100 parts by weight of the binder resin. By using these resins, the increase in residual electric potential with repeated use can be kept to a minimum. The thickness of the charge generation layer is preferably 0.01-2 μm.

Charge Transfer Layer

The charge transfer layer includes a charge transfer material (CTM) and a binder resin for dispersing the CTM and forming the film. Other material that may be included are additives such as an antioxidant in accordance with necessity.

A known electron positive hole transfer (p type) charge transfer material (CTM) is preferably used as the (CTM). For example, a triphenylamine derivative, a hydrazone compound, a styryl compound, a benzidine compound, a butadiene compound and the like may be used. These charge transfer materials are usually dissolved in a suitable binder resin, and layers are thereby formed. In these charge generation materials, the CTM with which the increase in residual electric potential with repeated use can be kept to a minimum has high mobility. The difference in ionizing potential of the CGM with which the charge transfer material is combined is 0.5 (eV) or less, and preferably 0.30 (eV) or less.

The difference in the ionization potential of the CGM and the CTM is measured by a surface analyzer AC-1 (manufactured by Riken Keiki Co., Ltd)

The binder resin used in the charge transfer layer (CTL) may be any of a thermoplastic resin or a thermosetting resin. Examples include polystyrene resin, acrylic resin, methacrylic resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, and copolymer resins including 2 or more repeated units of these resins. Examples other than these insulating resins include high polymer organic semiconductors such as poly-N-vinyl carbazole. Of these, the polycarbonate resins which have small water absorption coefficient and favorable CTM dispersion and electrophotographic properties are most preferable.

The proportion of the binder resin to the charge transfer material is preferably 50-200 parts by weight for 100 parts by weight of the binder resin.

Protective Layer

The organic photoreceptor of the present invention is preferably provided with a protective layer that has charge transfer functions and comprises fluorine based resin particles that cause the surface energy to be low. The fluorine based resin particles included in the protective layer are resin particles that include fluorine atoms, and preferable examples include tetrafluoroethylene resin, chlorotrifluoroethylene resin, ethylene propylene hexafluoride resin, vinyl fluoride, vinylidene fluoride resin, chlorodifluoroethylene resin, and 1 or 2 or more types of copolymers selected from these, but tetrafluoroethylene and vinylidene fluoride resin in particular are preferable. The molecular weight and particle diameter of the fluorine based resin particles are not particularly limited and may be suitably selected.

The protective layer preferably has a configuration in which fluorine based resin particles are included in the binder resin, and the proportion of the fluorine based resin particles to be used is affected by particle diameter, but 1-50% by weight for the total weight of the protective layer is preferable, and 5-40% by weight is more preferable. In addition, it is preferable that a charge transfer material is included in the protective layer.

Additives such as coupling agent or an antioxidant may be included in the protective layer to improve dispersing properties binding properties, and resistance to weathering.

Examples of the method for dispersing the fluorine based resin particles of the protective layer include methods using a homogenizer, ball mill, sand mill, roll mill, or supersonic waves. The method is not particularly limited provided that dispersion is possible for particle diameters up to that of the primary particle size.

Also, any surfactant such as a comb type graft polymer and the like, may be suitably mixed and used as the dispersing agent for the fluorine based resin particles without any problems.

It is preferable that the thickness of the protective layer is 0.1-4 μm. If the thickness is less than 0.1 μm the hardness and strength of the surface will be insufficient and a reduction in the durability is likely, while if the thickness exceeds 4 μm deterioration of the contrast potential formed by the latent image at the time of development is likely. The thickness is more preferably 0.2-3.0 μm.

It is preferable that the protective layer has low surface energy in order for the cleaning properties and contamination resistance of to be sufficient, and the low surface energy property when measured at the water contact angle is preferably 90° or more. If it is less than 90°, electrically charged products or toner and desorbed substance which leak from the paper will easily attach to the surface as a result of repeated use in the electrophotographic process. Also, it likely that deterioration of the latent image (image flow) due to cleaning defects, as well as reduction in surface resistivity will occur. The low surface energy property is more preferably 95° or more.

By employing the aforementioned structure, the sharpness is remarkably improved, and image defects such as image unevenness and mackle, which tend to occur when the charge transfer layer is made thin, are prevented, and an organic photoreceptor is provided in which the electric potential capacity is stable.

Listed as preferable solvents or dispersion mediums used in formation of the intermediate layer, the charge generation layer, the charge transfer layer are n-butylamine, diethylamine, ethylene diamine, isopropanol amine, triethanol amine, triethylene diamine N,N dimethylformamide, acetone, methylethyl ketone, methylisopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane methanol, ethanol, butanol, isopropanol, ethyl acetate, butyl acetate, dimethylsulfoxide, methylcellosolve and the like. The present invention is not to be limited by these examples, but dichloromethane, 1,2-dichloroethane, methylethyl ketone and the like are preferably used. Also, the solvents may be used singly or 2 or more may be mixed and used.

The coat treatment method used for preparing the organic photoreceptor may be immersion coating, spray coating, or circular volume rule coating, but so that the coating treatment on the upper layer side of the photosensitive layer does not completely dissolve the lower layer, and also in order to achieve a uniform coating treatment, spray coating or circular volume rule coating (circular slide hopper type or other typical examples) are the coat treatment methods preferably used. Incidentally, it is most preferable that the circular volume rule coat treatment method be used for the protective layer. The circular volume rule coating is described in detail in Japanese Laid-Open Publication No. 58-189061 gazatte for example.

Next, the developing agent used in the present invention will be described in detail. The developing agent used in the present invention is a two-component developing agent comprising a toner and a carrier.

(Carrier Component)

The volume resistivity of the carrier of the present invention is $10^8$-$10^{12}$ Ω cm.

The magnetic particles comprising the carrier may use known materials such as metals and alloys like iron, ferrite, magnetite, and the like.

The volume average particle diameter of the magnetic particles is preferably 15-100 μm, and more preferably 25-80 μm.

The measurement of the volume average particle diameter is done using a laser diffracting particle distribution measuring device "HELOS" (manufactured by Sympatec) which typically has a wet disperser.

The magnetic particles of the carrier used in the present invention are preferably those of magnetite or all types of ferrites. The ferrite is preferably a ferrite containing a heavy metal such as copper, zinc, nickel, manganese, or a light metal ferrite including an alkali metal and/or an earth metal. A light metal ferrite containing an alkali metal and/or an alkali earth is particularly preferable.

The components of the carrier include an alkali metal such as Li, Na and the like and/or an alkali earth such as Mg, Ca, Sr and Ba, and more specifically has the below composition.

$$(M_2O)_x(Fe_2O_3)_{1-x} \text{ or } (MO)_x(Fe_2O_3)_{1-x}$$

Also, a part of ($M_2O$) and/or ($Fe_2O_3$) may be substituted by an alkali earth metal oxide. M represents the alkali metal such as Li, Na and the like and/or an alkali earth such as Mg, Ca, Sr and Ba.

Also, x is 30 mol % or less and more preferably 25 mol % or less, and 1-30 mol % of a substituted alkali earth and/or alkali metal oxide is preferable. Still more preferable is 3-25 mol %. In this case other metals may be included and examples of these other metals include Mn, Ni and the like.

The resin composition for coating is not particularly limited, and examples that may be used are olefin resins, styrene resins, styrene-acrylic resins, silicone resins, ester resins, or fluorine containing polymer resins and the like.

The silicone resin can be favorably used in the present invention, and in particular, silicone resins having the segments shown in the general formulas (2) and (3) below are favorable.

General Formula (2)

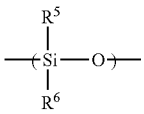

General Formula (3)

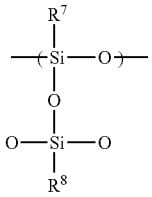

In the general formulas (2) and (3), $R^5$-$R^8$ respectively represent a hydrocarbon group selected from a methyl group, an ethyl group, a phenyl group, and a vinyl group. The methyl group is particularly favorable in view of binding properties and hardness. Also, modified silicone resins may be used such as alkyd modified, acrylic modified, polyester modified, phenol modified, melamine modified, urethane modified, and other modified silicone resins.

The ratio of the segments represented by general formula (2) and (3) is preferably (2)/(3)=0/100-70/30, and more preferably 0/100-50/50. In the case where (2)/(3)>70/30, the hardness is reduced because there are many straight chain components, and sufficient durability cannot be obtained.

Other additives may be added to the silicone resin. For example, generally known low molecular weight silane compounds such as a dealcoholization type, an acetate removing type, a deoximation type, a deamination type; an aminooxy removing type; an acetone removing type may be used as a crosslinking agent.

Examples of the hardening catalyst are metal salts such as Zn, Sn, Fe, Pb, Co, Ni, Al, Zr and the like, chelate compounds, organic compounds such as formic acid, acetic acid, bases such as amines and the like. Amino silane coupling agents may be added as the charge controlling agent.

The amount of the additive to be added is preferably 0.01-30 parts by weight to 100 parts by weight of the solid content of the silicone resin.

The solvents used for coating are toluene, xylene, methylethyl ketone, and methyl isopropyl ketone.

The amount of the resin coating on the resin coated carrier is 0.01-10% by weight with respect to the carrier core (magnetic particle), and more preferable 0.1-5% by weight. In the case where amount of the silicone resin coating is less than 0.01% by weight, there is the possibility that the coat layer may not be evenly formed. On the other hand, if it exceeds 10% by weight, carrier particles form granules with each other, and there is a remarkable decrease in flow properties and thus the carrier particles may be less mixable with the toner.

The method for forming a coating layer on the core is one in which the silicone resin is dissolved in a solvent and then the surface is coated by immersion, spray drying or the like, and then the solvent is removed by drying. In this case, the temperature is about 150-300° C. when baking is done, and in many cases the temperature is preferably 170-280° C. If the baking temperature is less than 150° C., the crosslinking reaction of the silicone resin is not carried out sufficiently and thus hardening is insufficient. On the other hand, if the temperature exceeds 300° C., a portion of the silicone resin dissolves and a uniform resin coat layer cannot be obtained.

In order to adjust the resistivity of the carrier, the resistivity of the carrier core itself may be adjusted and the thickness and composition of the resin coat layer of the surface may also be adjusted. For example, the resistivity of the carrier core itself is preferably 10 Ω·cm or more. The reason for this depends on the composition of the coat resin layer, but in the case where a uniform coat is not formed, the resistivity decreases and the carrier of the present invention is sometimes not formed. In addition, if the thickness of the resin coat layer is less than 0.1 μm, the resistivity becomes low and it is sometimes not possible to prepare the carrier of the present invention.

This carrier of the present invention is achieved by adjusting the thickness of the coat resin layer and the resistivity of the carrier core. Specifically, by causing the thickness of the coat layer to non-uniform in parts, the resistivity can be adjusted. The method for making the coat layer non-uniform is reducing the resin concentration when carrying out the coating and by not thoroughly coating the carrier core surface, but rather forming the carrier coating layer in accordance with the form of the core. As a result, the volume resistivity can be adjusted by making the convex part of the coating thin and the concave parts of the coating thick. In addition, the adjustment can be done by carrying out mechanical processing after coating is done and locally polishing the coating layer of the surface.

It is to be noted that the method for measuring the resistivity of the carrier is one in which a carrier which was left for 12 hours in a 25° C./50% RH environment, the carrier is loaded between the parallel electrodes, and then the height (H cm) is measured. Next, a direct current voltage of 1000V is applied between the electrodes in a state in which a constant load is applied (39.2 kPa), and after 30 seconds the current value (IA) is measured, and the resistivity is calculated using the calculation formula below. It is to be noted that the environment for measurement is 25° C. and 50% RH.

$$\text{Resistivity } (\Omega\cdot\text{cm})=1000/(I\times H)$$

(Toner Composition)

Next, the toner used for forming the toner image in the present invention will be described.

In the toner used for forming the toner image in the present invention:

1. The proportion of the toner particles which have a shape coefficient in the range from 1.2-1.6 is at least 65% by number.
2. Given that particle diameter of the toner particle is D (μm), in the histogram which shows the particle distribution based on numbers, in which the natural logarithm 1 nD is taken as the horizontal axis, and said horizontal axis is divided into a plurality of classes at an interval of 0.23, the total (M) of the relative frequency of toner particles included in the highest frequency class ($m_1$) and relative frequency of the toner particles included the second highest frequency class ($m_2$) is at least 70%.

That is to say, in the present invention, by using a developing agent including the toner which satisfies at least one of the conditions 1 and 2 in the organic photoreceptor, a favorable electrophotographic image is obtained in which image unevenness and blank areas in characters are prevented. It is more preferable that both conditions 1 and 2 are satisfied.

It is most preferable that a toner is used in which, in addition to the conditions 1 and 2, condition 3 below is also satisfied.

3. The proportion of non-angular toner particles at least is 50% based on number.

That is to say, by using the developing agent employing the toner which satisfies all of the conditions 1-3 and the carrier which has the volume resistivity of the present invention together with the thin layer organic photoreceptor of the present invention, that is, the organic photoreceptor in which the total thickness of the photosensitive layer and the protective layer which is provided in accordance with necessity is 5-15 μm (sometimes called thin organic photoreceptor hereinafter), there is remarkable improvement for image unevenness and blank areas in characters.

The toner of 1-3 above will be described in the following.

Toner Shape Coefficient (=the Shape Coefficient of the Toner Particle)

The tone particle shape coefficient is indicated by the formula below, and shows the degree of roundness of the toner particle.

$$\text{Shape coefficient}=[(\text{maximum diameter}/2)^2\times\pi]/\text{projection area}$$

wherein maximum diameter refers to the maximum width of the toner obtained by forming two lines such that the projection image of the particle on a plane is between said parallel lines. The projection area refers to the area of the projection image of said toner particle on a plane.

In the present invention, the shape coefficient is obtained by photographing a toner particle which has been magnified 2000 times using a scanning electron microscope. Subsequently, based on the resulting image, the photographic image is analyzed with a "SCANNING IMAGE ANALYZER" (Manufactured by JEOL). At this time 100 toner particles are used to calculate the shape coefficient of the present invention using the formula above.

In the toner of the present invention, the proportion of the toner particles having a shape coefficient in the range 1.2-1.6 is preferably at least 65% by number, and more preferably at least 70% by number.

In the present invention by developing the latent image that is formed on the thin organic photoreceptor using a developing agent comprising at least 65% by number of the toner particles having a shape coefficient in the range 1.2-1.6, a favorable electrophotographic image is obtained in which image unevenness and mackle are prevented, and sharpness is improved.

The method for controlling the shape coefficient is not particularly limited. Examples include methods in which toner particles having the shape coefficient adjusted to the range of 1.2 to 1.6 is prepared, such as a method in which the toner particles are sprayed in a heated air current; a method in which in which mechanical energy from an impact force is repeatedly applied to the toner particles in a vapor phase; and a method in which the toner is added to a solvent which does not dissolve the toner and then a revolving current is applied, and the resultant toner particles are added to a normal toner such that the toner is within the scope of the present invention. Also, there is another method in which at the step where the so-called polymerization method toner is prepared, the entire shape is controlled and the toner particles in which the shape coefficient has been adjusted to 1.2-1.6 are added to a normal toner in the same manner as above.

Of the methods aforementioned, the polymerization method toner is favorable in view of the fact that it is simple and surface uniformity is excellent compared to pulverized toners. Polymerization method toner (also called polymer toner) refers to one in which the formation of the binder resin for the toner and the configuration of the toner are done and by polymerizing the monomer comprising the binder resin; and if necessary, subsequently carrying out chemical processing. More specifically, it refers to a toner which is obtained by polymerization reactions such as suspension polymerization, emulsification polymerization, and if necessary, subsequently fusing the particles with each other.

In the polymerization toner, because the toner is prepared by uniformly distributing the monomers from which it is formed in an aqueous system and then subjecting the monomers to polymerization, a toner is obtained in which the toner particle distribution and shape are uniform.

In order to uniformly control the shape coefficient of the toner such that there is minimal fluctuation in the production lot, when the resin particles (polymer particles) comprising the toner of the present invention are prepared (polymerized), an appropriate finishing time may be determined while monitoring the properties of the toner particles (color particles) which are being formed in the processes of fusion and shape control of said resin particles.

Monitoring refers to controlling the processing conditions based on measurements done by installing a measuring device in-line. That is to say, a shape measurement device and the like are installed in-line, and for example, in the polymerization method toner formed by associating or fusing the resin particles in a aqueous medium, during processes such as fusion or the like, the shape and particle diameter are measured while successively carrying out sampling, and the reaction is terminated when the desired shape is obtained.

The monitoring method is not particularly limited, but the flow-type particle image analyzer FPIA 2000 (Manufactured by To a Medical Electronics Co., Ltd) may be used. This device is favorable because the shape can be monitored by carrying out image processing in real time while the sample liquid is being passed through. That is to say, normal monitoring can be carried out by using a pump and the like from the reaction site, and the shape and the like can be measured. The reaction is terminated when the desired shape is obtained.

Proportion of Non-Angular Toner Particles

The proportion of non-angular toner particles in the toner particles comprising the toner of the present invention must be at least 50% by number, and it is preferable that this proportion is at least 70% by number.

It is preferable that the proportion of non-angular toner particles comprising the toner of the present invention is preferably at least 50% by numbers, and more preferably at least 70% by number.

By developing the latent image formed on the thin organic photoreceptor of the present invention with the developing solution using the toner in which the proportion of non-angular particles is at least 50% by number, an electrophotographic image can be obtained in which image unevenness and mackle are prevented, and sharpness is favorable.

Here "non-angular toner particles" refers to a toner particle that has essentially no protrusions where charge may concentrate or which are likely to wear due to stress, and more specifically, the toner particles described in the following are non-angular toner particles. Namely, as shown in FIG. 2(*a*), given that the long diameter of the toner particle T is L, if circles C which have a radius of L/10 are formed around the inner side of the toner particle T such that the circle C contacts the circumferential line at one point, "non-angular toner" refers to the tone particle in which the circle C is "substantially along" the outer line of the toner T.

The expression "substantially along" means that there is one or less positions where the protrusion is not along the circle. Also, "long diameter of the toner" refers to the maximum width of the toner obtained by forming two parallel lines such that the projection image of the particle on a plane is between said parallel lines. It is to be noted that FIGS. 2(*b*) and 2(*c*) respectively show projection images of angular toner particles.

Measurement of the proportion of non-angular toner particles is carried out as follows. First, the toner particles are magnified using a scanning electron microscope, a photograph is taken and then it is further magnified to obtain a 15,000 times image. Next a determination is made as to whether or not the aforementioned angles are present. This determination is done for 100 toner particles.

The method for obtaining the non-angular toner particles is not particularly limited. For example, as aforementioned as a method for controlling the shape coefficient, the non-angular toner particles may be obtained by using a method in which the toner particles are sprayed in a hot air current; a method in which mechanical energy is repeatedly applied due to an impact force in a vapor phase, or a method in which the toner is added to a solvent which does not dissolve the toner and a revolving current is applied.

In addition, in the polymerization method toner which is formed by the resin particles being associated or fused, at the step where fusion is terminated, there are many concavities and convexities on the surface of the fused particles and thus they are not smooth. However, non-angular toner particles can be obtained by suitably selecting conditions such as the temperature, the rotation frequency of the stirring blade and stirring time in the shape controlling process. The conditions may vary in accordance with the physical properties of the resin, but for example, by increasing the rotation frequency at a temperature above the glass transition temperature of the resin particles, the surface of the particles will be smooth and a non-angular toner will be formed.

Toner Particle Diameter

A number based toner particle distribution is obtained by a Coulter TA or a Coulter multisizer (manufactured by Coulter, Inc.) In the present invention, the Coulter multisizer is connected to an interface (manufactured by Japan Analytical Instruments) and a personal computer which output the particle distribution. The aperture used in the Coulter multisizer is the 100 μm aperture. The number of particles were determined for toner volume of at least 2 μm and the particle distribution and average particle diameter was calculated. The number based particle distribution shows the relative frequency of the toner particles for each particle diameter, and the number based average particle diameter shows the median diameter of the number based particle frequency.

The toner particle diameter in the present invention is preferably 3.0-8.5 μm. In the case where the toner particle is formed using the polymerization method, the particle diameter is controlled by the concentration of the coagulating agent or the amount of the organic solvent added, as well as the fusion time and the composition of the polymer itself in the method for preparing the toner described hereinafter.

Because the number based average particle diameter is 3.0-8.5 μm, the transfer efficiency is increased and the half tone image quality is improved and the image quality for dots and fine lines and the like are improved.

For the toner of the present invention, given that particle diameter of the toner particle is D (μm), in the histogram which shows the particle distribution based on numbers, in which the natural logarithm 1 nD is taken as the horizontal axis, and said horizontal axis is divided into a plurality of classes at an interval of 0.23, the total (M) of the relative frequency of toner particles included in the highest frequency class ($m_1$) and the relative frequency of the toner particles included the second highest frequency class ($m_2$) is at least 70%.

In the present invention by using a developing agent using a toner in which the total (M) of the relative frequency ($m_1$) and relative frequency class ($m_2$) is at least 70% for the latent image formed on the thin organic photoreceptor, an electrophotographic image is obtained in which image unevenness and mackle are prevented and sharpness is favorable.

In the present invention, the histogram showing particle distribution based on the number of particles, the natural logarithm 1 nD (D: diameter of the toner particles) is divided into a plurality of classes of 0.23 intervals (0-0.23; 0.23-0.46; 0.46-0.69; 0.69-0.92; 0.92-1.15; 1.15-1.38; 1.38-1.61; 1.61-1.84; 1.84-2.07; 2.07-2.30; 2.30-2.53; 2.53-2.76 . . . . ), and this histogram is one which is created by a particle size distribution analyzing program in a computer to which the particle diameter data for the sample measured by the Coulter multisizer in accordance with the measuring conditions described below, was transferred via an I/O unit.

[Measuring Conditions]

(1) Aperture: 100 μm (2) Sample preparation method: A suitable amount of a surfactant (a neutral detergent) is added to 50-100 ml of an electrolyte (ISOTRON R-11 (manufactured by Coulter Scientific Japan) while stirring, and then 10-20 mg of the sample for measuring is added to the resultant mixture. This system is then subjected to dispersion for 1 minute in a supersonic wave disperser to thereby prepare the sample.

Method for Preparing the Toner

It is preferable that the toner of the present invention is a polymer toner obtained by polymerizing at least a polymerizable monomer in a aqueous medium, or a polymer toner obtained by associating at least resin particles in a aqueous medium. The method for preparing the polymer toner of the present invention (also simply called toner hereinafter) will be described in detail.

The polymer toner of the present invention is prepared by suspension polymerization method or by a method of preparing fine polymer particles (resin particles) by emulsion polymerization of a monomers in a solution (aqueous medium) to which has been added an emulsion of necessary additives, and then adding an organic solvent, a coagulating agent and the like to thereby associate the resin particles. "Associate" as used herein refers to the fusion of a plurality of resin particles and also includes the fusion of the resin particle with another particle (for example a colorant particle).

It is to be noted that in the present invention, the polymer refers to one in which one in which the formation of the binder resin for the toner and the configuration of the toner are done by polymerizing the monomer comprising the binder resin; and if necessary, subsequently carrying out chemical processing. More specifically, it refers to a toner which is obtained by polymerization reactions such as suspension polymerization, emulsification polymerization, and if necessary, subsequently fusing the particles with each other.

An example of a method for preparing the polymer toner of the present invention is adding various component materials such as a colorant, and as necessary a releasing agent and a charge control agent, as well as a polymerization initiator to the polymerizable monomer, and then dissolving or dispersing the various component materials in the polymerizable monomer using a homogenizer, sand mill, sand grinder, or a supersonic wave disperser. The polymerizable monomers, into which these various component materials are dissolved or dispersed, are dispersed into an aqueous medium comprising a dispersion stabilizer using a homomixer or a homogenizer or the like so as to form oil droplets having a desired size as the toner. Subsequently, the resulting dispersion is transferred to a reaction device (stirring apparatus) having a stirring mechanism composed of stirring blades described below, and undergoes polymerization reaction as a result of an increase in temperature. After completing the reaction, the dispersion stabilizer is removed, filtered, washed, and further dried to prepare the toner of the present invention.

It is to be noted that the "aqueous medium" in the present invention is a medium including at least 50% by weight of water.

Another example of the method for preparing the polymer toner of the present invention is one in which the polymer is prepared by conjugating or fusing the resin particles in an aqueous medium. This method is not particularly limited, and examples thereof are the methods described in Japanese Application Patent Laid-Open Publication No. Hei 05-265252 gazette, Japanese Application Patent Laid-Open Publication No. Hei 06-329947 gazette, Japanese Application Patent Laid-Open Publication No. Hei 09-15904 gazette. That is to say, a method in which the resin particles and dispersed particles of the component materials such as the colorants, or a plurality of the fine particles comprising the resin and the colorant are associated, and in particular, after these are dispersed in water using an emulsifier, salting out is done by adding a coagulant in excess of the critical coagulation concentration, and fused particles are simultaneously formed by thermal fusion at a temperature above the glass transition temperature of the polymer while gradually growing the particle diameter, and when the desired particle diameter is reached, a large amount of water is added to terminate particle diameter growth. Further, while heating and stirring, the particle surface is controlled such that the shape is smooth, and these particles are dried by heating while circulating and still in a hydrated state, and the toner of the present invention is thereby formed. It is to be noted that an infinite dissolution solvent may be added to the coagulant and water simultaneously.

Examples of the polymerizable monomers comprising the resin include: styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene; p-tert-butylstyrene; p-n-hexylstyrene; p-n-octylstyrene, p-n-nonylstyrene; p-n-decylstyrene, p-n-dodecylstyrene; methacrylic acid ester derivatives such as methyl methacrylic acid, ethyl methacrylic acid, n-butyl methacrylic acid, isopropyl methacrylic acid, isobutyl methacrylic acid, t-butyl methacrylic acid, n-octyl methacrylic acid, 2-ethylhexyl methacrylic acid, stearyl methacrylic acid, lauryl methacrylic acid, phenyl methacrylic acid, diethylaminoethyl methacrylic acid; acrylic acid ester derivatives such as methyl acrylate, ethyl acrylate, isopropyl acrylate, n-butyl acrylate, t-butyl acrylate isobutyl acrylate, n-octyl acrylate, 2-ethylhexyl acrylate, stearyl acrylate, lauryl acrylate, and phenyl acrylate, olefins such as ethylene, propylene and isobutylene; halogen based vinyls such as vinyl chloride, vinylidene chloride, vinyl bromide, vinyl fluoride, and vinylidene fluoride; vinyl esters such as vinyl propionate, vinyl acetate, vinyl benzoate; vinyl ethers such a vinylmethylether and vinylethylether; vinyl ketones such as vinyl methyl ketone, vinyl ethyl ketone, vinyl hexyl ketone; N-vinyl compounds such as N-vinylcarbazole, N-vinylindole, vinylpyrrolidone; vinyl compounds such as vinyl naphthalene and vinyl pyridine; acrylic acids and methacrylic acid derivatives such as acrylonitrile, methacrylonitrile, acrylamide. These vinyl based monomers may be used singly or in combination.

The polymerizable monomer comprising the resin is still more preferably used in combination with one which has an ionic dissociation group. Examples include those having substitution groups such as a carboxyl group, a sulfonic acid group or a phosphoric acid group as the group comprising the monomer. Specific examples include acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosphoxyethyl methacrylate, 3-chloro-2-acidphosphoxypropyl methacrylate and the like.

In addition, multifunctional vinyls such as divinyl benzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like may be used to form resin having a cross-linking structure.

These polymerizable monomers may be polymerized using a radical polymerization initiator. In this case, an oil-soluble polymerization initiator may be used in suspension polymerization method. Examples of the oil-soluble polymerization initiator that can be used include azo based and diazo based polymerization initiators such as 2,2'-azobis-(2,4-dimethyl valeronitrile), 2,2'-azobis-isobutyronitrile, 1,1'-azobis-(cyclohexane-1-1 carbonitrile), 2,2'-azobis-4-methoxy-2,4 dimethylvaleronitrile), azobis-isobutyronitrile and the like; and peroxide based polymerization initiators or high polymerinitiators that have peroxide on their side chain, such as benzoyl peroxide, methylethyl ketone peroxide, diisopropylperoxycarbonate, cumene hydroperoxide, t-butyl hydroperoxide, di-t-butyl peroxide, dicumylperoxide, 2,4-dicyclobenzoylperoxide, lauroyl peroxide, 2,2-bis-(4,4-t-butyl peroxycyclohexyl) propane, tris-(t-butylperoxy) triazine and the like.

Further, when the emulsification polymerization method is used, a water soluble radical polymerization initiator may be employed. Examples of the water soluble radical polymerization initiator include persulfates such as potassium persulfate and ammonium persulfate and the like; azobisaminodipropane acetic acid salts, azobiscyanovaleric acid, salts thereof and hydrogen peroxide and the like.

Examples of the dispersion stabilizer include, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina and the like. In addition, substances generally used as surfactants such as polyvinylalcohol, gelatin, methyl cellulose, sodium dodecylbenzenesulfonate, ethylene oxide addition products, high alcohol sodium sulfate and the like, may be used as the dispersion stabilizer.

Preferred as excellent resins in the present invention are those having a glass transition point of 20-90° C. as well as those having softening point of 80-220° C. The glass transition point is measured using the differential calorimetric method, and the softening point is measured using an elevated type flow tester. In addition, when the molecular weight of the resin is measured by gel permeation chromatography, the number average molecular weight (Mn) is preferably 1000-100,000, while the weight average molecular weight is preferably 2000-1,000,000. Also a molecular weight distribution of Mw/Mn is preferably 1.5-100 and 1.8-70 is particularly preferable.

The coagulant used when the resin particles are associated in an aqueous medium is not particularly limited, but is preferably selected from alkali metal salts of monovalent metals such as sodium, potassium, lithium and the like; alkali earth metal salts of divalent metals such as calcium, magnesium and the like; salts of divalent metal such as manganese and copper and the like, salts of trivalent metal such as iron and aluminum. Specific examples include sodium chloride, potassium chloride, lithium chloride, calcium chloride, zinc chloride, copper sulfate, magnesium sulfate, manganese sulfate and the like. These may be used in combination.

These coagulants are preferably added in a concentration exceeding the critical coagulation concentration. The critical coagulation concentration is an index of the stability of the aqueous dispersion, and indicates the concentration at which coagulation is formed when the coagulant is added. The critical coagulation concentration varies greatly in accordance with the components that are emulsified and the dispersing agent itself. For example, this is described in "Polymer Chemistry" 17, 601 (1960) by Seizo Okamura et. al, and edited by Nihon Kobunshi Gakkai, in which details of the critical coagulation concentration can be obtained. Furthermore, another method is changing the concentration by adding the desired salt to the particle dispersion to be obtained, and then measuring the ζ (zeta) potential of the dispersion. The salt concentration that changes this value is the critical coagulation concentration.

The amount of the coagulant to be added in the present invention is acceptable if it is more than the coagulation concentration, but this amount is preferably at least 1.2 times the critical coagulation concentration, and more preferably, at least 1.5 times the critical coagulation concentration.

The "solvent that is infinitely soluble in water" that is selected to be used with the coagulant is one which does not dissolve the resin to be formed. Specific examples include alcohols such as methanol, ethanol, propanol, isopropanol, t-butanol, methoxyethanol, butoxyethanol and the like; nitrites such as acetonitrile, and ethers such as dioxane. Ethanol, propanol and isopropanol in particular are preferable.

The amount of the solvent that is infinitely soluble in water to be added is preferably between 1 and 100 volume % of the dispersion including the polymer to which the coagulant is added.

It is to be noted that in order to make the shape of the particles uniform, after the colored particles are prepared and filtered, it preferable that the resulting slurry containing at least 10% by weight of the particles is subjected to fluidized drying, and at this time a polymer having a polar group is preferable. It is thought that the reason for this is, the water present has some moisturizing effect on the polymer having a polar group, and thus it is particularly easy to obtain uniformity in shape of the particles.

The toner of the present invention comprises as least a resin and a colorant, but it may also include a releasing agent which is a fixing property improving agent or a charge control agent and the like. In addition, external additives comprising fine inorganic particles or fine organic particles and the like may be added to the toner comprising the resin and the colorant described above.

Carbon blacks, magnetic bodies, dyes, pigments and the like may be suitably used as the colorant used in the toner of the present invention, and channel black, furnace black, acetylene black, thermal black, lamp black and the like may be used as carbon black. Examples of the magnetic material include ferromagnetic metals such as iron, nickel, cobalt and the like and alloys of these metals; ferromagnetic compounds such as ferrite and magnetite; alloys which do not contain ferromagnetic metals but exhibit ferromagnetic properties when subjected to thermal treatment. These alloys are called Heusler alloys and examples include manganese-copper-aluminum and manganese-bronze-tin; and chrome dioxide.

C.I. solvent red 1, solvent red 49, solvent red 52, solvent red solvent red 58, solvent red 63, solvent red 111, and solvent red 122, C.I. solvent yellow 19, solvent yellow 44, solvent yellow 77, solvent yellow 79, solvent yellow 81, solvent yellow 82, solvent yellow 93, solvent yellow 98, solvent yellow 103, solvent yellow 104, solvent yellow 112, solvent yellow 162, C.I. solvent blue 25, solvent blue 36, solvent blue 60, solvent blue 70, solvent blue 93, solvent blue 95 and the like, as well as mixtures thereof may be used as the dye. C.I. pigment red 5, pigment red 48:1, pigment red 53:1, pigment red 57:1, pigment red 122, pigment red 139, pigment red 144, pigment red 149, pigment red 166, pigment red 177, pigment red 178, pigment red 222, C.I. pigment orange 31 and pigment orange 43, C.I. pigment yellow 14, pigment yellow 17, pigment yellow 93, pigment yellow 94, pigment yellow 138, C.I. pigment green 7, C.I. pigment blue 15:3, pigment blue 60 and the like, as well as mixtures thereof may be used as the pigment. The preferable number based average primary particle diameter varies depending on the type, but is generally about 10-200 nm.

The method used for adding the colorant may be one in which the colorant is added at the step where the polymer prepared by the emulsification polymerization method is coagulated by adding a coagulant and the polymer is thereby colored, or in which, the colorant is added at the step where the monomer is polymerized to thereby carry out polymerization and form the colored particles and the like. It is to be noted that in the case where the colorant is added at the step where the polymer is prepared, it is preferable to use a coupling agent or the like to treat the surface so as not to hinder radical polymerization.

In addition, low molecular weight polypropylene (with a number average molecular weight of 1500-9000) or low molecular weight polyethylene and the like may be added as the fixing property improving agent.

The charge control agent used is a known charge control agent which can be dispersed in water. Specific examples include nigrosine dyes, metal salts of naphthenic acid or higher fatty acids, alkoxylated amines, quaternary ammonium salt compounds, azo based metal complexes, salicylic acid metal compounds or metal complexes thereof and the like.

It is to be noted that of the charge control agent and the fixing property improving agent are preferably in a dispersed state, and the number based average primary particle diameter is about 10-500 nm. By adding to the toner of the present invention, an external additive in which the number based average primary particle diameter of the particles such as the fine inorganic particles or the fine organic particles is 0.01-1.0 μm, the effects can be exhibited more. It is assumed that reason for this is that burying and releasing of the external additive can be effectively controlled, and thus image flow or image blurriness is controlled, and reproduction properties of the dot image can be improved.

Method for measuring the particle diameter of the external additive other than aforementioned.

The external additive particle diameter is denoted by the number based average primary particle diameter. The number based average particle diameter is obtained by magnifying the particles 2000 times by observing them under a transmission electron microscope, randomly observing 100 particles as the primary particles, and then measuring the length in the Fere direction by image analysis, to thereby obtain the number based average.

Preferable examples of the fine inorganic particles used are fine inorganic oxide particles such as silica, titania, alumina, and in addition it is preferable that these fine inorganic particles are subjected to hydrophobic treatment using a silane coupling agent, a titanium coupling agent and the like. Titanic acid salts such as strontium titanate acid, or hydroxytalcite are preferably used. The level of the hydrophobic treatment is not particularly limited, but it preferable that the methanol wettability is 40-90. Methanol wettability described herein evaluates the wettability of methanol. In this method, 0.2 g of the fine inorganic particles is weighed and added a 200 ml beaker with 50 ml of distilled water. Methanol is slowly added dropwise from a burette whose top is immersed in the solution such that stirring occurs slowly until all of the fine inorganic particles are wet. Given that the amount of methanol required to completely wet the fine inorganic particles is a (ml), the degree of hydrophobicity is calculated using the formula below.

$$\text{Degree of hydrophobicity}=[a/(a+50)]\times 100$$

The amount of the external additive to be added is 0.1-5.0% by weight of the toner, and preferably 0.5-4.0% by weight. In addition, various substances may be combined and used as the external additive.

In the suspension polymerization method toner which is prepared by dispersing or dissolving the toner components such as the colorant and the like in the so-called polymerizable monomer and suspension in a aqueous medium and which then undergoes polymerization to obtain the toner, by controlling the flow of the medium in the reaction device in which the polymerization reaction is carried out, the shape of the toner particle can be controlled. That is to say, in the case where many toner particles having a shape coefficient of at least 1.2 are to be formed, the flow of the medium in the reaction device is caused to be turbulent, polymerization proceeds, and because the oil drops that are suspended in the aqueous medium are gradually polymerized, the oil drops become soft particles, and at this point particle union is accelerated due to collision of the particles, and particles that do not have a stable shape are thereby obtained. In the case where small substantially spherical toner particles having a shape coefficient of not more than 1.2 are to be formed, the flow of the medium in the reaction device is caused to be laminar, and because collision of the particles is avoided, a substantially spherical particle is obtained. As a result of this method, the distribution of the toner shape can be controlled so as to be within the range specified by the present invention.

Figure 3:
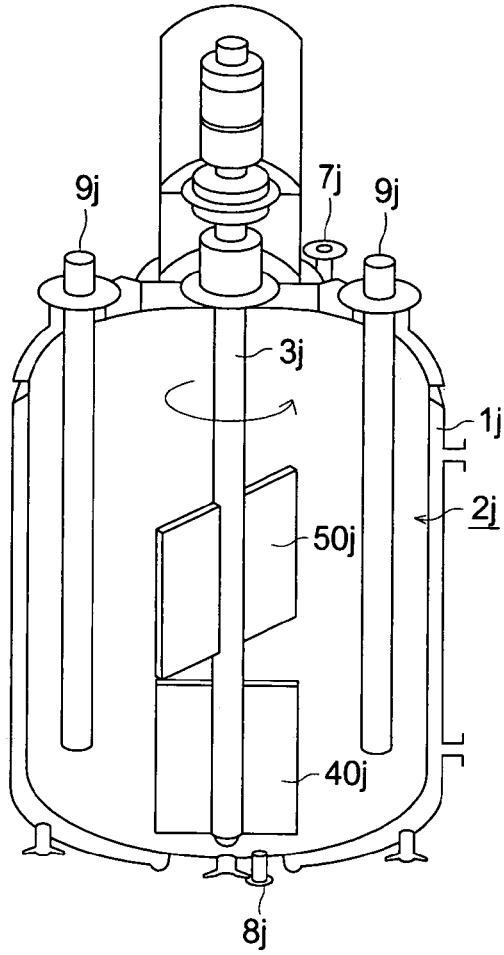
FIG. 3 is a perspective view of an example of the polymer toner reaction device.
Figure 4:
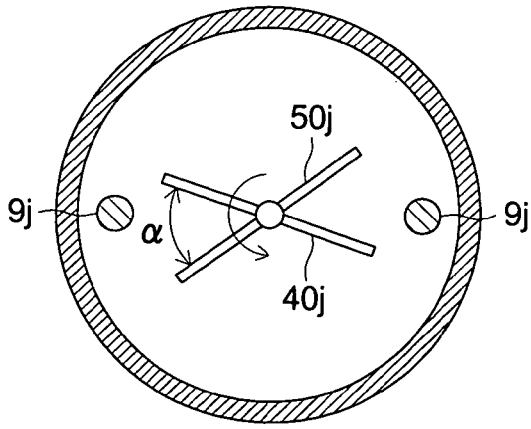
FIG. 4 is cross-sectional view of an example of the polymer toner reaction device.

Next, the reaction device that is preferably used in preparing the polymer toner will be described. FIGS. 3 and 4 respectively show perspective view and a cross-sectional view of an example of the polymer toner reaction device. In the reaction device shown in FIGS. 3 and 4, a rotation shaft 3*j* is provided in the center of the stirring tank 2*j* which has a vertical cylinder having a heat exchange jacket 1*j* mounted in the outer periphery thereof. The rotation shaft 3*j* is provided with a lower stirring blade 40*j* which is disposed so as to contact the bottom surface of the stirring tank 2*j* and a stirring blade 50*j* which is provided at an upper level. The upper stirring blade 50*j* is disposed so as to have an angle of intersection α when it advances in the rotation direction with respect to the stirring blade 40*j* which is positioned at the lower level. When the toner of the present invention is being prepared, it is preferable that the angle of intersection α is less than 90 degrees (°). The lower limit of the angle of intersection α is not particularly limited, but it is preferably 5° or more, and more preferably 10° or more. It is to be noted that when a stirring blade having a three level structure is provided, it is preferable that the respective adjacent blades have an angle of intersection α of less than 90°.

Because of this type of structure, the medium is first stirred by the stirring blade 50*j* which is disposed at the upper level and the flow is formed toward the lower side. Next, the flow formed by the upper level stirring blade 50*j* is further accelerated by the stirring blade 40*j* which is disposed at the lower level, and at the same time the stirring blade 50*j* itself forms a separate flow toward the lower direction, and it can be assumed that the and overall flow is accelerated and proceeds. As a result, it is estimated that because a flow region is formed as turbulent flow that has a large shear stress, the shape of the obtained toner particles can be controlled.

It is to be noted that in FIGS. 3 and 4, the arrows show the rotation direction; 7*j* is the upper material inlet port; 8*j* is the lower material inlet port; and 9*j* is the turbulent flow forming member for making stirring effective.

Figure 5:
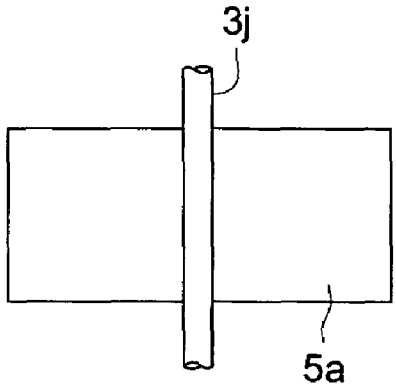
FIG. 5 shows the schematic structure of a specific example of the configuration of the stirring blade.
Figure 5:
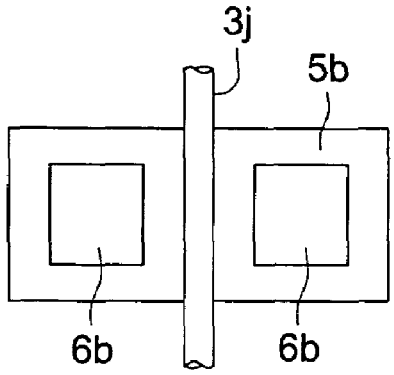
Figure 5:
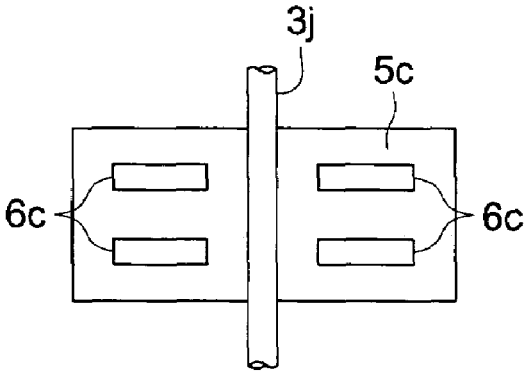
Figure 5:
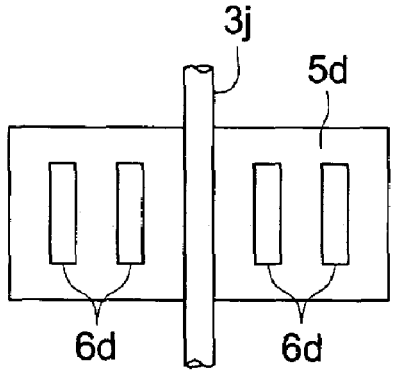

The configuration of the stirring blade is not particularly limited, but a square plate blade, a blade with a notched portion, or a blade with more than one opening in the center, that is a slit blade, may be used. Specific examples of these are shown in FIG. 5. The stirring blade 5*a* shown in 5(*a*) does not have any opening; the stirring blade 5*b* shown in (b) has a large opening 6*b* in the center; the stirring blade 5*c* shown in (c) has width-wise openings 6*c* (slits); and the stirring blade 5*d* shown (d) has length-wise openings. In the case where a stirring blade with a three level structure is provided, the openings formed in the upper level stirring and that formed in the lower level stirring blade may be the same or different.

It is to be noted that distance between the upper level and lower level mixing blades having the above-described structure is not particularly limited, but it is preferable that there is at least some distance between the stirring blades. The reason for this is not clear, but it maybe that the flow of the medium is formed via this distance, and thus this configuration improves stirring efficiency. However, the width of the distance should be 0.5 to 50%, and more preferably 1-30% of the height of the liquid surface in a stationary state.

Also, the size of the stirring blade is not particularly limited, but the total of the entire height of the stirring blade should be 50 to 100%, and more preferably 60 to 90% of the liquid surface height in a stationary state.

On the other hand, in the polymerization method toner in which the resin particles are associated or fused in a aqueous medium, by controlling the medium flow and the temperature distribution inside the reaction device in the fusing process, and by also controlling the heating time, the stirring rotation frequency and time in the shape control process which is subsequent to the fusing process, the shape distribution and shape of all of the toner can be freely changed.

That is to say, in the polymer method toner in which the resin particles are associated or fused, a toner having a desired shape coefficient and uniform shape distribution can be formed by controlling temperature, rotation frequency and time during the fusing process and in the shape control process, and using a stirring blades and a stirring tank such that the flow in the reaction device is regulated to be laminar and the internal temperature distribution is uniform. It is assumed that this is because when fusion is done in the case where a laminar flow is formed, no strong stress applied to the particles when they coagulate and fuse (the associated or coagulate particles), and in the accelerated laminar flow, the temperature distribution in the stirring tank is uniform, and as a result the shape distribution of the fused particles is uniform. In addition, due to heating and stirring in the subsequent shape controlling process, the fused particles can be gradually made spherical, and thus the shape of the toner particles can be freely controlled.

The stirring tank used for preparing the polymerization method toner in which the resin particles are associated or fused is similar to that of the suspension polymerization. method described above. In this case, it is important that there are no obstacles such as baffles which form turbulent flow within the stirring tank.

The configuration of the stirring blade too is not particularly limited provided that it forms a laminar flow and not a turbulent flow, but the square plate type shown in FIG. 5(*c*), or the type formed from connecting surfaces is preferable, and it may also have a curved surface.

(Image Forming Method and Image Forming Apparatus)

Next, the image forming method and image forming apparatus of the present invention will be described.

Figure 6:
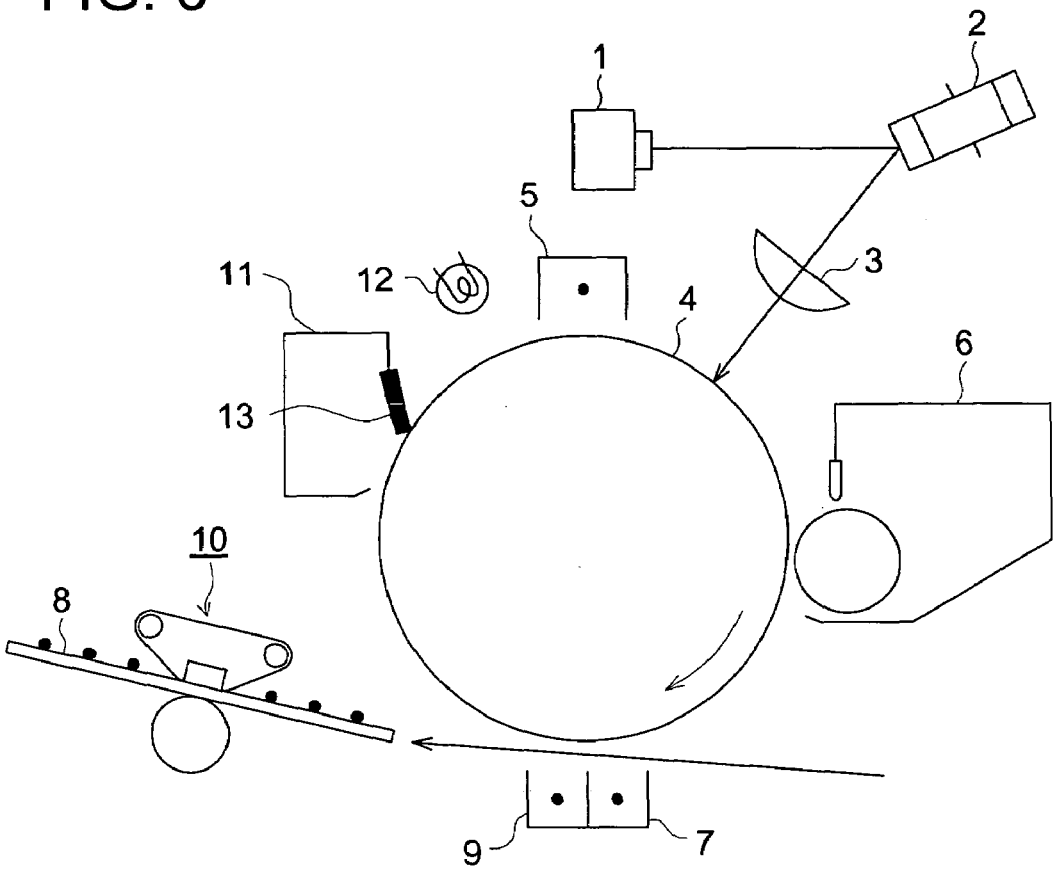
FIG. 6 shows the schematic structure of the image forming device of the present invention.

FIG. 6 is a schematic view of the image forming apparatus which shows an example of an embodiment of the present invention. 4 is an organic photoreceptor (OPC) in which an organic photoconductive layer, which is a photoreceptor, is disposed on the outer peripheral surface of an aluminum drum substrate, and which rotates at a prescribed speed in the direction of the arrow. In the example of this embodiment, the external diameter of the photoreceptor 4 is 60 mm.

In FIG. 6 exposure light is emitted from a semiconductor laser light source 1, based on information read from an document original reading device which is not shown. The exposure light is split by the polygon mirror 2 in a direction perpendicular to the paper surface, and irradiated onto the photoreceptor surface via the fθ lens 3 for correcting image warp, and a latent electrostatic image is thereby created. The photoreceptor is uniformly pre-charged by the charger 5, and then rotation in the clockwise direction so as to match the image exposure timing begins.

The latent electrostatic image on the surface of the photoreceptor is developed by the developing device (also the developing process) 6, and the developed image that was formed is transferred by the action of the transfer device 7, to the image support 8 which is conveyed in corresponding timing. In addition, the photoreceptor 4 and the image support 8 are separated by the separator 9 (separating electrode), but the toner developed image is transferred so as to be supported to the support 8, and led to the fixing device 10 and fixed.

The toner that was not transferred and which remains on the photoreceptor surface is cleaned using a cleaning blade type cleaning device 11, and the remaining charge is removed by the pre-charge exposure (PCL) 12, and the photoreceptor is uniformly charged again by the charger 5 for the next image formation.

It is to be noted that that image support is typically regular paper, but it is not particularly limited provided that the unfixed image may be transferred after development, and needless to say a PET base for OHP may be used.

The cleaning blade 13 is an elastic rubber body with a thickness of about 1-30 mm and the material used to form the blade is most often urethane rubber.

The beam that was irradiated from the above mentioned scanning optical system has a circle shaped or oval shaped distribution that is similar to a regular distribution in which the bottom extends horizontally, and for example in the case of a laser beam, normally, the circle or oval in the main scanning direction or the sub-scanning direction or both directions have the extremely small size of 20-100 μm.

The so-called non contact development method in which the distance between the development sleeve and the latent electrostatic image forming body (photoreceptor) is wider than the thickness of the image layer; or the generally used contact method in which it is smaller may be used in the present invention without any particular limits. In addition, in each case a vibrating electric field may be applied to the developing region.

Figure 7:
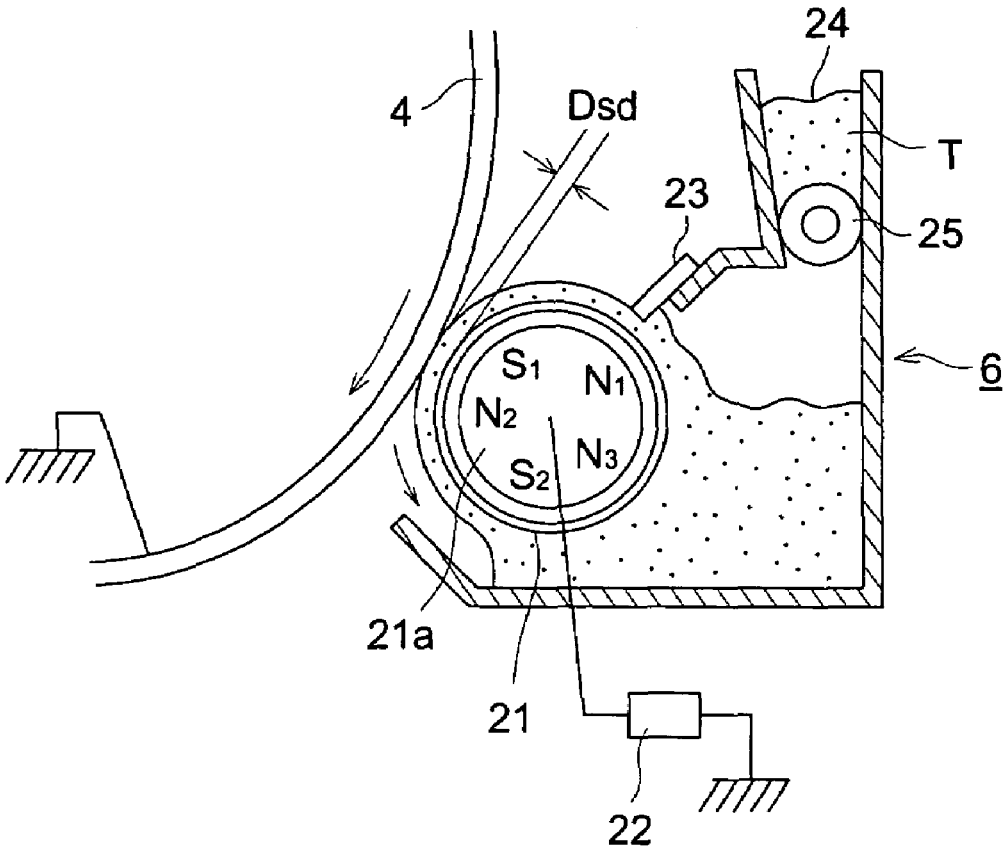
FIG. 7 is a cross-sectional view of an example of the developing device.

FIG. 7 is a cross-sectional view of the developing device 6 used for carrying out the development method of the present invention.

A developing agent comprising toner T and a carrier is stored inside the developing device shown in FIG. 7, and the development sleeve (developing agent conveying member) 21 which conveys this developing agent is a cylindrical developing sleeve in which a magnet roller 21*a* which has a plurality of magnetic poles $N_1$, $S_1$, $N_2$, $S_2$, $N_3$ are provided at the inner periphery side. The development sleeve 21 is rotatably disposed via an appropriate distance Dsd so as to oppose the photoreceptor 4 in the developing region. In addition the development sleeve 21 is the opposite direction from the photoreceptor 4, and that is to say, in the development region where the development sleeve 21 and the photoreceptor 4 oppose each other, the development sleeve 21 and the photoreceptor 4 rotate so as to move in the same direction, and the developing agent 20 which is stored inside the development device 6 is conveyed with the rotation of the development sleeve 21, to the photoreceptor side based on the state of the magnetic brush as a result of the magnetic action of the magnet roller 21*a*.

A development bias power source 22 is connected to the development sleeve 21, and a development bias voltage is applied from the development bias power source 22 which has an alternate current voltage or an alternate current voltage onto which a direct current voltage has been superimposed, and a vibrating electric field is generated in the developing region. It is preferable the vibrating electric field is such that the relationship between the distance Dsd between the development sleeve and the photoreceptor and the peak-peak value of the alternate current voltage (Vp−p) is preferably:

$$3\ \text{kV/mm} \leqq (Vp\text{-}p/Dsd) \leqq 5\ \text{kV/mm}.$$

At the upstream side in the developing agent conveying direction of the developing region where the development sleeve 21 and the photoreceptor 4 oppose each other, a magnetic blade 23 is provided via the necessary distance from the development sleeve 21 at a position that opposes the magnetic pole N1 of the magnetic roller 21*a*. The amount of the developing agent on the development sleeve 21 is regulated by the magnetic blade 23.

This developing device 6, has a toner storage section 24 which stores the toner T at the upper portion thereof, and the toner T which is in the developing agent is fed to the photoreceptor 4 from the development sleeve 21 and development is carried out. As a result, if the concentration of the toner in the developing agent which is in the developing device 6 is low, the toner replenishing roller 25 which is provided under the toner storage section 24 rotates and the toner T which is stored in the toner storage section 24 is fed to the developing device 6.

Furthermore, after the conveyance amount of the developing agent is adjusted by the development sleeve 21, the developing agent is led to the development region which opposes the photoreceptor 4 by the development sleeve 21, and a bias voltage is applied by the from the development bias power source 22. A vibrating electrical field is created in the development region, and the toner T in the developing agent which was conveyed in by the development sleeve 21 is fed to the latent image section of the photoreceptor 4 from the development sleeve 21 and development is thereby carried out.

The image forming apparatus described above can be formed such that a process cartridge comprising at least one of the photoreceptor 4, the charger 5, the developing device 6, the cleaning device 11 or the transfer device 7 can be loaded therein.

Figure 8:
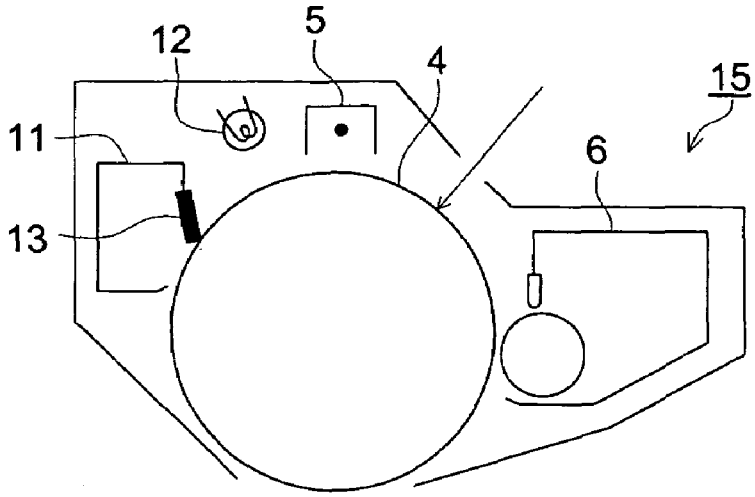
FIG. 8 shows a cross-sectional view and a perspective view of the process cartridge.
Figure 8:
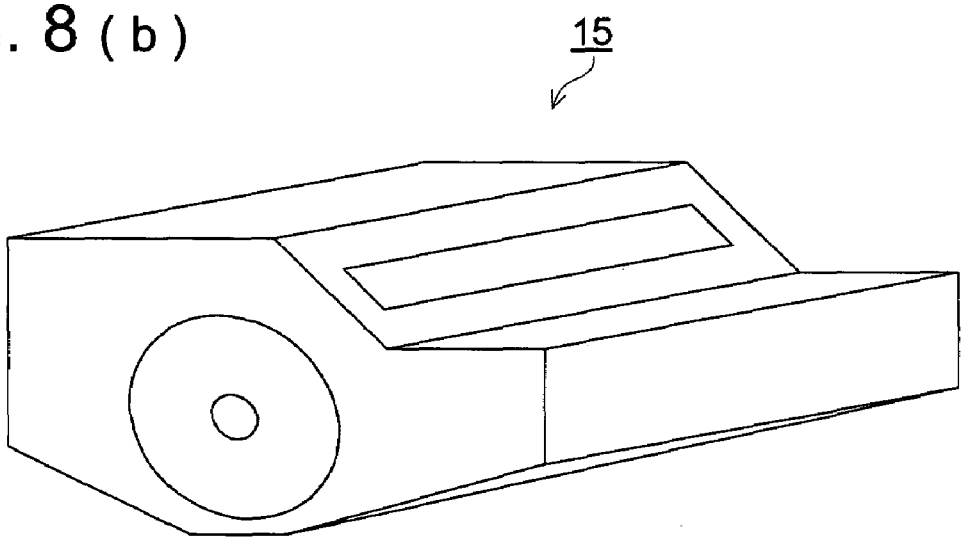

An example of the process cartridge for loading into the image forming device of the present invention is shown in FIG. 8 as a cross-sectional view (a) and a perspective view (b). The process cartridge 15 is loaded by a guide rail or the like, into the image forming device from the side, or in other words, from the direction that is at right angles with the direction in which the image support is conveyed.

As is clear from FIG. 8, the process cartridge 15 of this example is formed as a single unit, into which the photoreceptor 4 which is the main component, the developing device 6, the cleaning device 11, and the PCL 12 are stored. This configuration of the process cartridge can be considered a preferable embodiment of the present invention.

The fixing device 10 for use in the present invention may be the heat roller type or any other type. Also, a cleaning mechanism may be included if necessary. In this case, a system for feeding silicone oil to the roller of the fixing device may be a cleaning method in which the silicone oil is fed by a pad, a roller, a web, or the like which has been impregnated with the silicone oil.

The silicone oil used is one having high heat resistance, and examples include polydimethyl silicone, polyphenylmethyl silicone, polydiphenyl silicone and the like. The flow amount of a silicone oil with low viscosity is large at the time of use, and thus a silicone oil having a viscosity of 1-100 Pa·s at 20° C. is preferably used. The coating amount of the silicone oil is preferably 0.1-10 $\mu g/cm^2$.

EXAMPLES

The following is a detailed description of the present invention using examples. However, the invention is not to be limited by these examples. It is to be noted that in the following "parts" refers to "parts by weight".

Preparation of Photoreceptor 1

The photoreceptor 1 was prepared in the following manner.

The surface of a cylindrical aluminum support having a diameter of 100 mm and a length of 346 mm was cut to prepare a conductive support with a surface roughness of Rz=1.5 (μm).

<Intermediate Layer>

The intermediate layer dispersion was diluted to 2 times in the same mixed solvent, and then filtered after being left overnight (Filter: Nihon Pall Ltd., ridge mesh 5 μm filter), and the intermediate layer coating solution was thereby prepared.

| | |
|---|---|
| Polyamide resin CM 8000 (Manufactured by Toray Industries Inc.) | 1 part |
| Titanium oxide (number based average particle diameter: 35 nm, titanium oxide that has undergone silica/aluminum treatment and methylhydrogenpolysiloxane treatment) | 3 parts |
| Methanol | 10 parts |

The substances above were mixed and a sand mill was used as a disperser, and dispersion was carried out for 10 hours in batches, to thereby prepare the intermediate layer dispersion.

The above coating solution was coated onto the support so as to have a dry thickness of 1.5 μm.

Charge Generation Layer: CGL

Charge Generation Materials (CGM)

| | |
|---|---|
| Titanyl phthalocyanine pigment (F: Cu-Kα characteristic X-ray diffraction angle: Titanyl phthalocyanine pigment having notable peaks at 7.5° and 28.6° at a Bragg angle of 2θ | 60 parts |
| Polyvinyl butyl resin (BL-S: Manufactured by Sekisui Chemical Co., Ltd.) | 700 parts |
| 2-butanol | 2000 parts |

The substances above were mixed and dispersed for 30 hours using a sand mill, to thereby prepare the charge generation layer coating solution. This coating solution was coated onto the intermediate layer using the immersion coating method so as to form a charge generation layer having a dry thickness of 0.5 μm.

<Charge Transfer Layer (CTL)>

| | |
|---|---|
| Charge transfer material (4,4'-dimethyl-4''-(α-phenylstyryl) triphenylamine | 225 parts |
| Polycarbonate (Z300: Manufactured by Mitsubishi Gas Chemical Company, Inc.) | 300 parts |
| Antioxidant (Irganox 1010: Manufactured by Cibasophy Chiba-Geigy Japan Limited) | 6 parts |
| Dichloromethane | 2000 parts |
| Silicone oil (KF-54: Manufactured by Shin-Etsu Chemical Co., Ltd) | 1 part |

The substances above were mixed and dissolved to thereby prepare the charge transfer layer coating solution 1. The coating solution was coated onto the charge generation layer using the immersion coating method and then dried for 70 minutes at 110° C. so as to form a charge transfer layer having a dry thickness of 10 μm.

Preparation of 4-ethylene Fluoride Resin Particle Dispersion

| | |
|---|---|
| 4-ethylene fluoride resin particles (Lubron L-2, Manufactured by Daikin Industries, Ltd.) | 200 parts |
| Polycarbonate resins (Z300: Manufactured by Mitsubishi Gas Chemical Company, Inc.) | 200 parts |
| Monochlorobenzene | 600 parts |
| Fluorine based comb graft polymer (Trade name GF300, Manufactured by Toa Gosei Kagaku Kogyo Co., Ltd.) | 8 parts |

The substances above were mixed and dispersed with a sand grinder using glass beads (manufactured by Ammex Co. Ltd.) to thereby prepare the 4-ethylene fluoride resin dispersion.

<Protective Layer>

| | |
|---|---|
| 4-ethylene fluoride resin particles dispersion | 1500 parts |
| Charge generation material (4,4'-dimethyl-4"-(α-phenylstyryl) triphenyl amine) | 1225 parts |
| Polycarbonate (Z300: Manufactured by Mitsubishi Gas Chemical Company, Inc.) | 800 parts |
| Antioxidant (Irganox 1010: Manufactured by Cibasophy Chiba-Geigy Japan Limited) | 12 parts |
| Dichloromethane | 3000 parts |
| Monochlorobenzene | 5000 parts |
| Silicone oil (KF-54: Manufactured by Shin-Etsu Chemical Co., Ltd) | 4 parts |

The substances above were mixed and dissolved to thereby prepare the charge transfer coating solution 2. The coating solution was coated onto the above charge transfer layer using a circular slide hopper coater and dried for 70 minutes at 110° C. so as to form a protective layer having a dry thickness of 2 μm, and thereby prepare the photoreceptor 1.

Preparation of Photoreceptors 2-9

The photoreceptors 2-9 are prepared in the same manner as in the preparation of photoreceptor 1, except that the titanium oxide of the intermediate layer, the thickness of the charge generation layer (CGL), and the thickness of the charge transfer layer and the protective layer and the fluorine based resin are changed as shown in Table 1.

Preparation of Photoreceptor 10

The photoreceptor 10 is prepared in the same manner as the photoreceptor 1, except that the protective layer is not included.

TABLE 1

| | Intermediate layer | | | | | Protective layer | | | |
|---|---|---|---|---|---|---|---|---|---|
| Photo-receptor No. | Fine Particle Diameter (nm) | Surface Treatment | Thickness of intermediate layer (μm) | Thickness of charge Genera-tion Layer (μm) | Thickness of charge transfer layer (μm) | Resin Fine Particles | Film thickness (μm) | *1 | Remarks |
| 1 | 35.0 | A | 1.5 | 0.5 | 10.0 | G(200) | 2.0 | 12.5 | *2 |
| 2 | 35.0 | A | 1.5 | 0.5 | 12.5 | G(200) | 2.0 | 15.0 | *2 |
| 3 | 35.0 | A | 1.5 | 0.5 | 4.0 | G(200) | 2.0 | 6.5 | *2 |
| 4 | 35.0 | A | 1.5 | 0.5 | 14.5 | G(200) | 1.0 | 16.0 | *3 |
| 5 | 35.0 | A | 1.5 | 0.5 | 2.5 | G(200) | 1.0 | 4.0 | *3 |
| 6 | 70.0 | B | 1.5 | 0.3 | 12.5 | H(100) | 1.0 | 13.8 | *2 |
| 7 | 140.0 | C | 1.5 | 1.0 | 8.0 | H(100) | 2.0 | 11.0 | *2 |
| 8 | 35.0 | A | 1.5 | 2.0 | 10.0 | H(100) | 2.0 | 14.0 | *2 |
| 9 | 35.0 | A | 1.5 | 0.5 | 5.5 | G(200) | 2.0 | 8.0 | *2 |
| 10 | 35.0 | A | 1.5 | 0.5 | 10.0 | — | 0.0 | 10.5 | *2 |

*1: Total film thickness of the charge generation layer, charge transfer layer and the protective layer (μm)
*2: Within the present invention
*3: Not within the present invention The fine particle surface treatments A, B and C in Table 1 denote the following processes.

A: silica/alumina treatment and methylhydrogenpolysiloxane treatment

B: silica/alumina treatment and octyltrimethoxysilane treatment

C: silica/zirconia treatment and methyltrimethoxysilane

G and H are the fluorine based resin fine particles below.

G: Ethylene tetrafluoride resin particles (Lubron L-2, manufactured by Daikin Industries, Ltd.)

H: Ethylene trifluoride resin particles (Daifron L-2, manufactured by Daikin Industries, Ltd.)

Preparation of Toner and Developing Agent

Toner Preparation Example 1

Example of Emulsification, Polymerization and Association Method 0.90 kg of sodium n-dodecyl sulfate was added to 10.0 liters of pure water and dissolved while stirring. 1.20 kg of Regal 300R (carbon black manufactured by Cabot Corporation) was gradually added to the resultant solution. After stirring well for 1 hour, the solution was continuously dispersed for 20 hours using a sand grinder (a medium type disperser). This resultant dispersion was designated as the "fixing agent dispersion 1".

In addition, a solution of 0.055 kg of sodium dodecylbenzenesulfonate and 4.0 liters of deionized water was designated the "anion surfactant solution A".

A solution of 0.014 kg of nonyl phenol polyethylene oxide 10-mol addition product and 4.0 litres of deionized water was designated as the "nonion surfactant solution B".

A solution formed by dissolving 223.8 g of potassium persulfate and 12.0 litres of deionized water was designated as the "initiator solution C".

3.41 kg of a wax emulsion (a polypropylene emulsion with a number average molecular weight of 3000, a number based average primary particle diameter of 120 nm, and a solid portion concentration of 29.9%) and all of the "anion surfactant solution A" and all of the "nonion surfactant solution B" were placed into a 100 liter GL (glass lining) reactor vessel fitted with a temperature sensor, a cooling pipe, and a nitrogen introducing device, and the resultant mixture was stirred. Next 44.0 liters of the deionized water were added.

The mixture was heated to 75° C. and all of "Initiator Solution C" was added drop-wise. Subsequently, while the solution temperature was controlled so as to be 75° C.±1° C., 12.1 kg of styrene, 2.88 kg of n-butyl acrylate, 1.04 kg of methacrylic acid, and 548 g of t-dodecylmercaptan were added drop-wise. After completing the drop-wise addition, the solution temperature was increased to 80° C.±1° C., and stirred while heating for 6 hours. Next, the resultant mixture was cooled to less than 40° C. and stirring was terminated. Filtering was done using a pole filter to thereby obtain latex. This filtrate was designated as "Latex A".

It is to be noted that the glass transition temperature of the resin particles in Latex A was 57° C. and the softening point was 121° C. The molecular distribution is such that weight average molecular weight is 127,000, and the weight average particle diameter is 120 nm.

A solution in which 0.055 kg of sodium dodecylbenzenesulfonate and 4.0 liters of deionized water were dissolved was designated as the "anion surfactant solution D".

A solution of 0.014 kg of nonyl phenol polyethylene oxide 10-mol addition product and 4.0 litres of deionized water was designated as the "nonion surfactant solution E".

A solution formed by dissolving 200.7 g of potassium persulfate (manufactured by Kanto Kagaku) and 12.0 liters of ionized water was designated as the "initiator solution F".

3.41 kg of a wax emulsion (a polypropylene emulsion with a number average molecular weight of 3000, a number based average primary particle diameter of 120 nm, and a solid portion concentration of 29.9%) and all of the "anion surfactant solution D" and all of the "nonion surfactant solution E" were placed into a 100 liter GL (glass lining) reactor vessel fitted with a temperature sensor, a cooling pipe, and a nitrogen introducing device and a comb-shaped baffle, and the resultant mixture was stirred.

Next 44.0 liters of deionized water were added. The mixture was heated to 70° C. and the "initiator solution F" was added. Subsequently, a solution which was prepared beforehand by mixing 11.0 kg of styrene, 4.00 kg of n-butyl acrylate, 1.04 kg of methacrylic acid, and 9.02 g of t-dodecylmercaptan was added drop-wise. After the drop-wise addition was completed, the temperature of the mixture was controlled to 72° C.±2° C., and stirring was carried out while heating for 6 hours. The temperature of the mixture was further increased to 80° C.±2° C., and then stirring was done while heating for 12 hours. Next, the solution temperature was cooled to not more than 40° C. and stirring was terminated. Filtering was done with a pole filter and the resultant filtrate was designated as "Latex B".

It is to be noted that the glass transition temperature of the resin particles in Latex A was 58° C. and the softening point was 132° C. The molecular distribution is such that weight average molecular weight is 245,000, and the weight average particle diameter is 110 nm.

A solution in which 5.36 kg of sodium chloride was dissolved in 20.0 liters of deionized water was designated as the "sodium chloride solution G".

A solution in which 1.00 g of fluorine based nonion surfactant was dissolved in 1.00 liter of deionized water was designated as the "non ion surfactant solution H".

20.0 kg of latex A, 5.2 kg of latex B and 0.4 kg of the colorant dispersion 1 prepared above, and 20.0 kg of ionized water were placed in a 100 liter SUS reactor vessel (reaction device having the structure shown in FIG. 3 with an intersection angle of 25°) which is fitted with a temperature sensor, a cooling pipe, a nitrogen introducing device, and a particle diameter and shape monitoring device, and the resultant mixture was stirred. Next the temperature was increased to 40° C. and sodium chloride solution G and 6.00 kg of isopropanol (manufactured by Kanto Kagaku) and nonion surfactant solution H were sequentially added. The resultant mixture was left for 10 minutes and then heated until it reached 85° C. for 60 minutes, and at 85° C.±2° C., stirring while heating was done for 0.5-3 hours to cause salting out/fusion by increasing particle diameter (salting out/fusion process). Next, 2.1 liters of pure water were added to terminate particle growth, and the fused particle dispersion was thereby prepared.

5.0 kg of the fused particle dispersion prepared above were put into a 5 liter reactor vessel (reaction device having the structure shown in FIG. 3 with an intersection angle of 20°) fitted with a temperature sensor, a cooling pipe, and a particle diameter and shape monitoring device, and the shape was controlled (shape control process) by stirring for from 0.5-15 hours at the dispersion temperature of 85° C.±2° C. Subsequently, the resultant dispersion was cooled to not more than 40° C. and stirring was terminated. Classification was then carried out in the mixture by the centrifugal precipitation method using a centrifugal separator, and the resultant mixture was filtered with a sieve with openings of 45 μm. The resultant filtrate was designated as the association solution. Next, the non-spherical particles that appear like wet cake were filtered out using a Nutsche filter and then washed using deionized water. The resultant non-spherical particles were dried with a flush jet drier at an intake temperature of 60° C., and then dried at 60° C. using a fluidized bed drier. 1.0% by weight of hydrophobic silica (with a number based average particle diameter of 20 nm and hydrophobicity of 68) and 0.3% by weight of hydrophobic titanium oxide (with a number based average particle diameter of 200 nm, and hydrophobicity of 63) were externally mixed with 100 parts by weight of the resultant colored particles to thereby obtain the toner using the emulsification polymerization association method.

Toners 1-6 comprising particles having the shape properties and particle distribution properties shown in Table 2 were obtained by controlling the stirring rotation frequency and the heating time during the monitoring of the salting out/fusion process and also by the shape controlling process, the variation coefficient shape and the particle diameter, and in addition by freely adjusting the particle diameter and the variation coefficient of the particle distribution classification in the solution.

TABLE 2

| Toner No. | Proportion of toner particles with shape coefficient of 1.2–1.6 (%) | M ($m_1 + m_2$) | Proportion non-angular toner particles (%) | Number based average particle diameter of toner particles (μm) |
|---|---|---|---|---|
| 1 | 66.3 | 80.7 | 88 | 5.6 |
| 2 | 73.2 | 82.3 | 94 | 8.1 |
| 3 | 65.1 | 71.4 | 52 | 3.7 |
| 4 | 63.4 | 70.5 | 51 | 5.3 |
| 5 | 65.1 | 67.4 | 51 | 5.6 |
| 6 | 60.5 | 68.3 | 42 | 5.7 |

Carrier Formation

Preparation of Core Material 22 mol % of $Li_2O$ and 78 mol % of $Fe_2O_3$ were ground and blended in a wet ball mill for 2 hours, and then left for 2 hours at 900° C. after drying to thereby carry out preliminary calcination. The resultant mixture was ground in a ball mill for 3 hours to give a slurry. A dispersant and a binder were added, and then pelletization was done using a spray dryer and then drying carried out. Subsequently, actual calcination was done for 3 hours at 1200° C., and ferrite core particles with a volume average particle diameter of 60 μm were obtained.

Preparation of Carrier 1

A 10% by weight concentration solution in which 100 parts by weight of a silicone resin (solid content 50%) in which $R^5$-$R^8$ in the general formula (2) and (3) are $CH_3$ and the segment ratios of (2)/(3) is 2/98, and 2 parts by weight of γ-aminopropyltrimethoxysilane are added to a toluene solvent was prepared. Next, of ferrite core particles were coated with 0.5% by weight of the resultant solution using a fluidized bed, and then baked for 3 hours at 190° C. to thereby obtain coating particles 1. Next the coating particles were loaded into a mechanomill (manufactured by Okada Seiko Co., Ltd.), and mixed by stirring for 5 minutes with the number of revolution being 1000 rpm, and carrier 1 was thereby obtained. The volume resistivity of this carrier was $2\times10^{10}$ Ω·cm.

Preparation of Carrier 2

A carrier was obtained in the same manner as in the example for preparing carrier 1, except that the coating amount was 1.0% by weight. This was designated as "carrier 2"

Preparation of Carrier 3

A carrier was obtained in the same manner as in the example for preparing carrier 1, except that the mechanomill processing time was 30 minutes. This was designated as "carrier 3".

Preparation of Carrier 4

A carrier was obtained in the same manner as in the example for preparing carrier 1, except that the mechanomill processing time was 40 minutes. This was designated as "carrier 4".

Preparation of Carrier 5

A carrier was obtained in the same manner as in the example for preparing carrier 2, except that the mechanomill processing time was 30 minutes. This was designated as "carrier 5".

Preparation of Carrier 6

A carrier was obtained in the same manner as in the example for preparing carrier 1, except that the concentration of the coating solution was changed from 10% by weight to 20% by weight. This was designated as "carrier 6".

Preparation of Carrier 7

A carrier was obtained in the same manner as in the example for preparing carrier 1, except that the concentration of the coating solution was changed from 10% by weight to 20% by weight and the coating amount was 2.0% by weight. This was designated as "carrier 7".

Preparation of Carrier 8

A carrier was obtained in the same manner as in the example for preparing carrier 7, except that the mechanomill processing time was 1 minute. This was designated as "carrier 8".

The results of measuring the resistivity of the carriers above are shown in Table 3 below.

TABLE 3

| Carrier No. | Resistivity |
|---|---|
| Carrier 1 | $2 \times 10^{10}$ Ω · cm |
| Carrier 2 | $5 \times 10^{11}$ Ω · cm |

TABLE 3-continued

| Carrier No. | Resistivity |
|---|---|
| Carrier 3 | $9 \times 10^{9}$ Ω · cm |
| Carrier 4 | $2 \times 10^{7}$ Ω · cm |
| Carrier 5 | $8 \times 10^{10}$ Ω · cm |
| Carrier 6 | $7 \times 10^{10}$ Ω · cm |
| Carrier 7 | $8 \times 19^{11}$ Ω · cm |
| Carrier 8 | $2 \times 10^{12}$ Ω · cm |

Preparation of the Development Agent

The above carriers 1-8 which have been coated with a silicone resin are used in combination with each of the above toners 1-6 are and mixed, and developing agents 1-13 having a toner concentration of 6% are thereby prepared.

The developing agents prepared are shown below in Table 4

TABLE 4

| Developing agent No. | Toner No. | Carrier No. | Remarks |
|---|---|---|---|
| 1 | 1 | 1 | Within the present invention |
| 2 | 2 | 1 | Within the present invention |
| 3 | 3 | 1 | Within the present invention |
| 4 | 4 | 1 | Within the present invention |
| 5 | 5 | 1 | Within the present invention |
| 6 | 6 | 1 | Within the present invention |
| 7 | 1 | 2 | Within the present invention |
| 8 | 1 | 3 | Within the present invention |
| 9 | 1 | 4 | Not within the present invention |
| 10 | 1 | 5 | Within the present invention |
| 11 | 1 | 6 | Within the present invention |
| 12 | 1 | 7 | Within the present invention |
| 13 | 1 | 8 | Not within the present invention |

Evaluation

The photoreceptors 1-10 and the developing agents 1-3 were used in combination as shown in Table 5, and evaluation of actual copies made with remodeled digital copier Konica 7060 manufactured by Konica was carried out.

TABLE 5

| Combination No. | Photoreceptor No. | Developing agent No. | Toner No. | Carrier No. | Remarks |
|---|---|---|---|---|---|
| 1 | 1 | 1 | 1 | 1 | Within the present invention |
| 2 | 1 | 2 | 2 | 1 | Within the present invention |
| 3 | 1 | 3 | 3 | 1 | Within the present invention |
| 4 | 1 | 4 | 4 | 1 | Within the present invention |
| 5 | 1 | 5 | 5 | 1 | Within the present invention |
| 6 | 1 | 6 | 6 | 1 | Within the present invention |
| 7 | 1 | 7 | 1 | 2 | Within the present invention |
| 8 | 1 | 8 | 1 | 3 | Within the present invention |
| 9 | 1 | 9 | 1 | 4 | Not within the present invention |
| 10 | 1 | 10 | 1 | 5 | Within the present invention |
| 11 | 1 | 11 | 1 | 6 | Within the present invention |
| 12 | 1 | 12 | 1 | 7 | Within the present invention |

TABLE 5-continued

| Combination No. | Photoreceptor No. | Developing agent No. | Toner No. | Carrier No. | Remarks |
|---|---|---|---|---|---|
| 13 | 1 | 13 | 1 | 8 | Not within the present invention |
| 14 | 2 | 1 | 1 | 1 | Within the present invention |
| 15 | 3 | 1 | 1 | 1 | Within the present invention |
| 16 | 4 | 1 | 1 | 1 | Not within the present invention |
| 17 | 5 | 1 | 1 | 1 | Not within the present invention |
| 18 | 6 | 1 | 1 | 1 | Within the present invention |
| 19 | 7 | 1 | 1 | 1 | Within the present invention |
| 20 | 8 | 1 | 1 | 1 | Within the present invention |
| 21 | 9 | 1 | 1 | 1 | Within the present invention |
| 22 | 10 | 1 | 1 | 1 | Within the present invention |

The evaluation conditions of the remodeled Konica 7060 are listed below.

Charge Conditions

Charger: Scorotron charger, initial charge target: −500V to −600V

Exposure Conditions

Exposure section electric potential target: exposure amount set to −50V

Exposure beam: Image exposure of dot density 400 dpi (dpi refers to the number of dots per 2.54 cm) is carried out. Laser beam spot area is $0.8\times10^{-9}$ $m^2$ and the laser used is 680 nm semiconductor laser.

Development Conditions (Reversal Development Conditions)

Development bias; DC bias =−400V to −500V

Dsd (distance between photoreceptor and development sleeve); 600 μm

Thickness of developing agent layer; 700 μm

Development sleeve diameter; 40 mm

Transfer Conditions

Transfer electrode; Corona charge type

Separation conditions; using a separation means with a separation claw unit

Cleaning Conditions

Cleaning blade

A polyurethane elastic rubber blade with rubber hardness of JISA 70°, impact resilience of 55, thickness of 2 mm, and free length of 9 mm is brought into contact with the photoreceptor at a contact angle of 20° and with a pressing force of 20 g/cm in the counter direction of the rotation of the photoreceptor, using the overlap load system.

Items for Evaluation

Image Unevenness

Image unevenness: 100,000 copies were made continuously in the remodeled Konica 7060 under high humidity and high temperature conditions (HH: 30° C. and 80RH %), and after copying was complete, the half tone image whose density was 0.4 in the original image was copied with a 0.4 density, and the density difference of the copy image (ΔHD=maximum density−minimum density) is determined.

A: ΔHD is 0.05 or less (favorable)

B: ΔHD is greater than 0.05 but less than 0.1 (not problematic for practical use)

D: ΔHD is 0.1 or more (problematic for practical use)

Evaluation of mackle

After 100,000 copies were made continuously as described above, a grid image with a width of 5 cm which was created from 0.1 mm lines with the original image in the front end section was evaluated. The evaluation was done by enlarging the image 20 times and observing the continuity of the line and the occurrence of smear.

A: no mackle

B: the mackle level is insignificant as it cannot be seen by visual observation, and the thin line is continuous.

C: the mackle level is such that it can be seen by visual observation but the thin line is continuous.

D: the mackle level is such that it can be seen by visual observation and the thin line is discontinuous in some places.

(Sharpness)

After 100,000 copies were made continuously as described above, the character breakage was evaluated based on the evaluation standards below.

A: Both 3 point and 5 point are clear and easily readable.

B: Some of the 3 point is unreadable, while 5 point is clear and easily readable D: 3 point is mostly unreadable, and some or all of 5 point is unreadable

TABLE 6

| Combination | Image unevenness | Mackle | Sharpness | Remarks |
|---|---|---|---|---|
| 1 | A | A | A | Within the present invention |
| 2 | A | A | A | Within the present invention |
| 3 | A | A | A | Within the present invention |
| 4 | A | B | B | Within the present invention |
| 5 | A | B | B | Within the present invention |
| 6 | B | B | B | Within the present invention |
| 7 | A | A | A | Within the present invention |
| 8 | A | A | A | Within the present invention |
| 9 | D | D | D | Not within the present invention |
| 10 | A | A | A | Within the present invention |
| 11 | A | A | A | Within the present invention |
| 12 | A | A | A | Within the present invention |
| 13 | D | D | D | Not within the present invention |
| 14 | A | A | B | Within the present invention |
| 15 | B | A | B | Within the present invention |
| 16 | B | B | D | Not within the present invention |
| 17 | D | D | D | Not within the present invention |
| 18 | A | A | A | Within the present invention |
| 19 | A | A | A | Within the present invention |
| 20 | A | A | A | Within the present invention |
| 21 | A | A | A | Within the present invention |

TABLE 6-continued

| Combination | Image unevenness | Mackle | Sharpness | Remarks |
|---|---|---|---|---|
| 22 | A | B | B | Within the present invention |

As is clear from Table 6, the combinations Nos. 1-8, 10-12, that 14, 15, and 18-22 which satisfy the conditions of the photoreceptor of the present invention, or in other words, the conditions by which the total thickness of the photosensitive layer (the charge generation layer and the transfer layer) is 5-15 μm in the organic photoreceptor and the volume resistivity of the carrier is $10^8$-$10^{12}$ Ω·cm in the two component developing agent, show results in which the items being evaluated, which are image unevenness, character smear, and sharpness, are improved as compared to the combinations 9, 16, and 17 in which at least one of the aforementioned conditions is not satisfied. In particular, even for the combinations that are within the present invention, the improvement is remarkable for Nos. 1-3, 7, 8, 10-12, 18-21 which satisfy the conditions by which the total thickness of the photosensitive layer and the protective layer is 8-14 μm, the organic photoreceptor has a protective layer including fluorine particles; at least 65% of the toner particles in the developing solution have a shape coefficient in the of range 1.2-1.6; and the total (M) of the relative frequency of toner particles including the highest frequency class ($m_1$) and relative frequency of the toner particles including the frequency class next to the highest frequency class ($m_2$) is at least 70%. On the other hand, the combination 16 which uses the photoreceptor 4 in which the total thickness of the photosensitive layer and the protective layer is 16 μm, has reduced sharpness, and in the combination 17 which uses the photoreceptor 5 in which the total thickness of the photosensitive layer and the protective layer is 4 μm, the electric potential is insufficient and image unevenness is generated, and thus the overall evaluation is poor.

In addition, the combination 9 which uses the developing agent 9 in which the volume resistivity of the carrier is $10^8$ Ω·cm or less and the combination 13 which uses a developing agent 13 in which the volume resistivity of the carrier is at least $10^{12}$ Ω·cm, the overall evaluation is poor.

By using the image forming method of the present invention, the occurrence of image unevenness and blank areas in characters due to abrasion which tends to occur in the organic photoreceptor having a thin photosensitive layer are prevented, and an electrophotographic image have resolution can be obtained. Also, an image formation device is provided which use said image forming method and in which image properties are favorable.

What is claimed is:

1. An image forming method, comprising the steps of:

charging an organic photoreceptor having a specific layer including at least a photosensitive layer;

forming an electrostatic latent image on the organic photorecptor;

developing the electrostatic latent image to form a visible toner image by using a developing agent;

transferring the toner image to be superimposed on a toner image receiving member; and removing the toner remaining on the organic photoreceptor, wherein a total thickness of the specific layer of the organic photoreceptor is 5-15 μm, and wherein the developing agent comprises a toner and a carrier having a volume resistivity of $10^8$-$10^{12}$ Ω cm.

2. The image forming method of claim 1, wherein the toner comprises 65% or more in terms of number of toner particles that have a shape coefficient in the range from 1.2-1.6.

3. The image forming method of claim 1, wherein a total (M) of the relative frequency ($m_1$) of toner particles included in the highest frequency class and relative frequency ($m_2$) of the toner particles included the second highest frequency class is at least 70%, when particle diameter of the toner particle is D (μm), in the histogram which shows the particle distribution based on numbers, in which the natural logarithm 1 nD is taken as the horizontal axis and said horizontal axis is divided into a plurality of classes at an interval of 0.23.

4. The image forming method of claim 1, wherein the toner comprises an inorganic external agent with a particle diameter of 0.01-1.0 μm.

5. The image forming method of claim 1, wherein the carrier is a magnetic particle coated with a silicone polymer.

6. The image forming method of claim 1, wherein the specific layer comprises a protective layer provided in the organic photoreceptor.

7. The image forming method of claim 1, wherein the specific layer includes a protective layer having a thickness of 0.1-4 μm.

8. The image forming method of claim 7, wherein the thickness of the protective layer is 0.2-3.0 μm.

9. The image forming method of claim 1, wherein the carrier comprises a magnetic particle having a volume average particle diameter of 15-100 μm and a resin covering the magnetic particle.

10. The image forming method of claim 9, wherein the volume average particle diameter of the magnetic particles is 25-80 μm.

11. The image forming method of claim 9, wherein the magnetic particle is a ferrite.

12. The image forming method of claim 11, wherein the magnetic particle is a light metal ferrite.

13. The image forming method of claim 9, wherein the resin is an olefin resin, styrene resin, styreneacrylic resin, silicone resin, ester resins, or fluorine resin.

14. The image forming method of claim 9, wherein an amount of the resin covering the magnetic particle is 0.01-10% by weight with respect to the magnetic particle.

15. The image forming method of claim 14, wherein an amount of the resin covering the magnetic particle is 0.1-5% by weight with respect to the magnetic particle.

16. The image forming apparatus comprising:

an organic photoreceptor having a specific layer and at least a photosensitive layer;

a means for developing the electrostatic latent image on the organic photoreceptor with a developing agent to form a visable toner image;

means for transferring the toner image to a toner from the organic photoreceptor to a toner image receiving member to form an image on the receiving member; and means for removing toner remaining on the organic photoreceptor after transferring the image to the receiving member, wherein a total thickness of the specific layer of the organic photoreceptor is 5-15 μm, and wherein the developing agent comprises a toner and a carrier having a volume resistivity of $10^8$-$10^{12}$ Ω cm.

* * * * *